US009001169B2

(12) United States Patent
Kanda et al.

(10) Patent No.: US 9,001,169 B2
(45) Date of Patent: Apr. 7, 2015

(54) PRINTER AND RECORDING MEDIUM

(71) Applicants: Mitsuhiro Kanda, Nagoya (JP); Satoru Moriyama, Nagoya (JP)

(72) Inventors: Mitsuhiro Kanda, Nagoya (JP); Satoru Moriyama, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/176,391

(22) Filed: Feb. 10, 2014

(65) Prior Publication Data

US 2014/0225972 A1 Aug. 14, 2014

(30) Foreign Application Priority Data

Feb. 13, 2013 (JP) ..... 2013-025201

(51) Int. Cl.

| | |
|---|---|
| ***B41J 2/325*** | (2006.01) |
| ***B65H 20/36*** | (2006.01) |
| ***B65H 20/00*** | (2006.01) |
| ***B41J 11/46*** | (2006.01) |
| ***B41J 15/04*** | (2006.01) |

(52) U.S. Cl.

CPC ..... *B65H 20/36* (2013.01); *B65H 20/00* (2013.01); *B41J 11/46* (2013.01); *B41J 15/042* (2013.01)

(58) Field of Classification Search

USPC ..... 347/171, 187, 193, 101, 104, 105, 213, 347/215, 217, 218

See application file for complete search history.

(56) References Cited

FOREIGN PATENT DOCUMENTS

| | | |
|---|---|---|
| EP | 1582364 | 10/2005 |
| EP | 2236302 | 10/2010 |
| JP | 2007216617 | 8/2007 |
| WO | 2008117106 | 10/2008 |

OTHER PUBLICATIONS

Extended European Search Report issued in Application No. EP 14154864.4 on Jun. 3, 2014.

*Primary Examiner* — Kristal Feggins

(74) *Attorney, Agent, or Firm* — McCarter & English, LLP

(57) ABSTRACT

The disclosure discloses a printer comprising a storage device, a feeder, a printing head, an instruction input portion, a first control portion, a detection determining portion, and a second control portion. The printing head performs desired printing on the print-receiving medium fed in a forward direction along a transport direction by a feeder. The instruction input portion inputs an operation instruction for starting print processing. The first control portion controls the feeder so as to start feeding of the print-receiving medium in the forward direction. The detection determining portion determines whether or not a detecting device detects the identifier after feeding in the forward direction was started. The second control portion controls the feeder so as to feed the print-receiving medium in a reverse direction, and to position a position of the print-receiving medium in a predetermined first initial position.

4 Claims, 15 Drawing Sheets

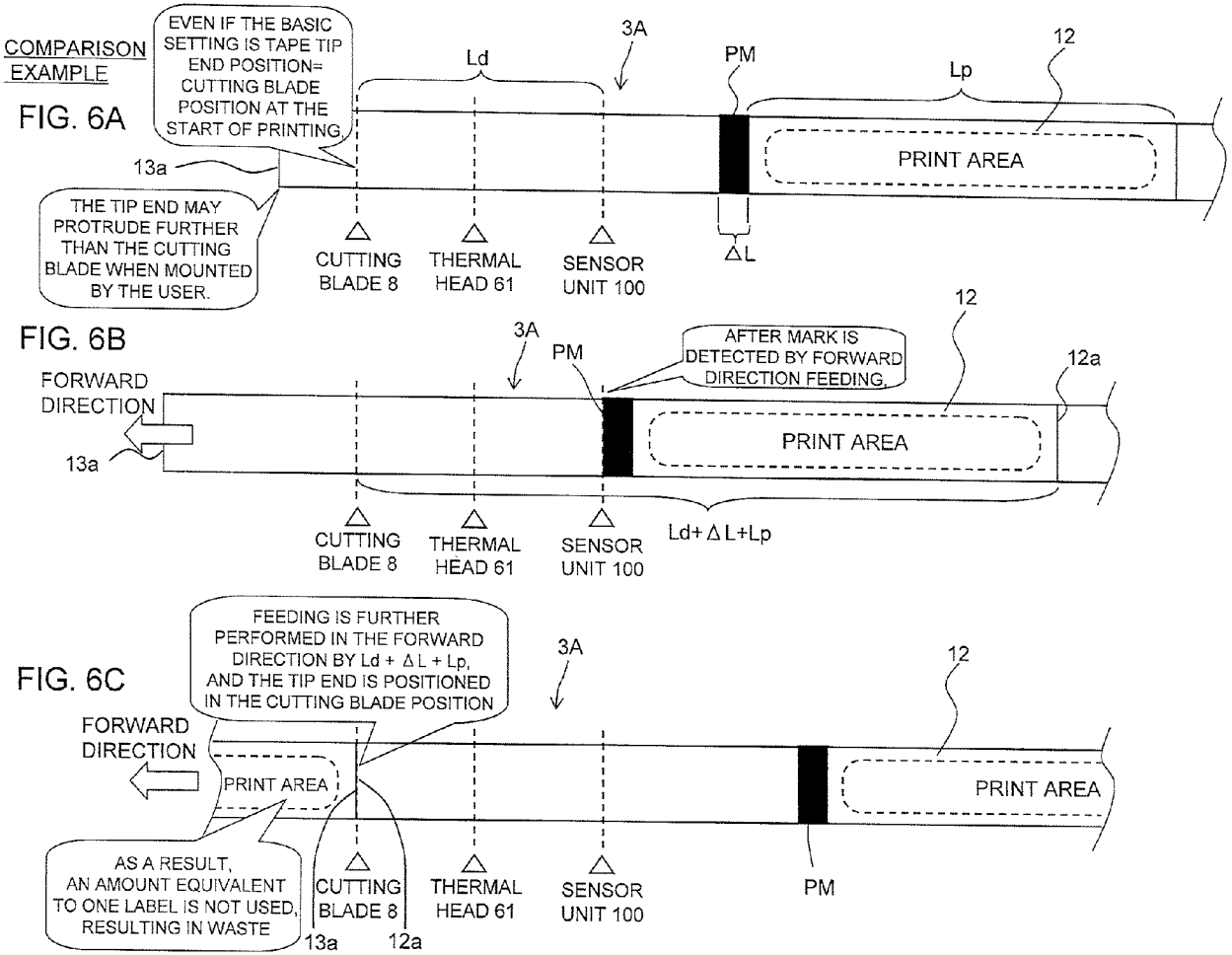
COMPARISON EXAMPLE
FIG. 6A
EVEN IF THE BASIC SETTING IS TAPE TIP END POSITION= CUTTING BLADE POSITION AT THE START OF PRINTING
THE TIP END MAY PROTRUDE FURTHER THAN THE CUTTING BLADE WHEN MOUNTED BY THE USER.
13a
Ld
3A
PM
Lp
12
PRINT AREA
ΔL
CUTTING BLADE 8
THERMAL HEAD 61
SENSOR UNIT 100
FIG. 6B
FORWARD DIRECTION
13a
3A
PM
12
12a
PRINT AREA
AFTER MARK IS DETECTED BY FORWARD DIRECTION FEEDING.
Ld+ΔL+Lp
CUTTING BLADE 8
THERMAL HEAD 61
SENSOR UNIT 100
FIG. 6C
FORWARD DIRECTION
FEEDING IS FURTHER PERFORMED IN THE FORWARD DIRECTION BY Ld + ΔL + Lp, AND THE TIP END IS POSITIONED IN THE CUTTING BLADE POSITION
PRINT AREA
AS A RESULT, AN AMOUNT EQUIVALENT TO ONE LABEL IS NOT USED, RESULTING IN WASTE
13a
12a
CUTTING BLADE 8
THERMAL HEAD 61
SENSOR UNIT 100
3A
12
PRINT AREA
PM

EMBODIMENT
(WHEN REVERSE DIRECTION FEEDING IS PERFORMED)

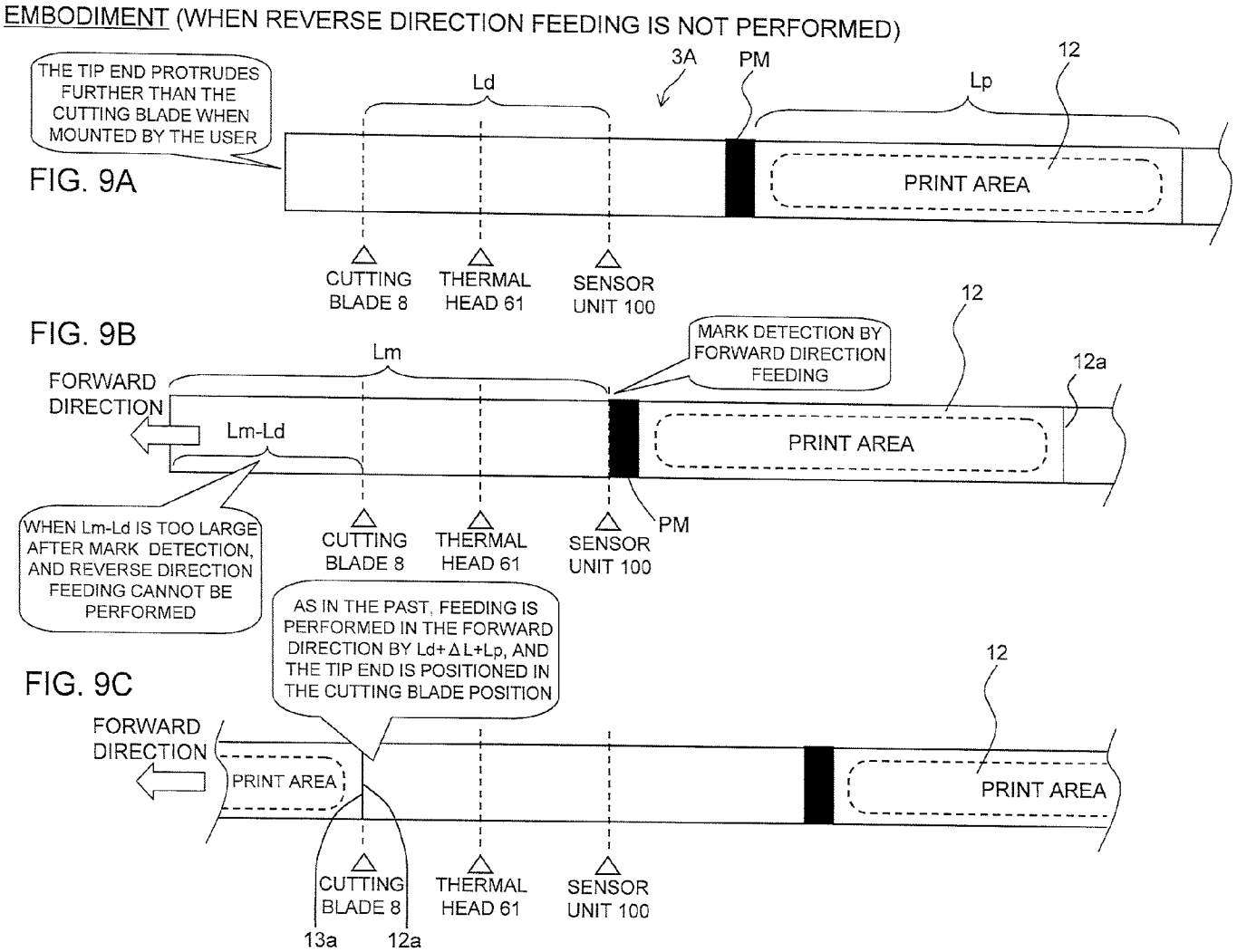
EMBODIMENT (WHEN REVERSE DIRECTION FEEDING IS NOT PERFORMED)
THE TIP END PROTRUDES FURTHER THAN THE CUTTING BLADE WHEN MOUNTED BY THE USER
FIG. 9A
12
Lp
PRINT AREA
PM
3A
Ld
SENSOR UNIT 100
THERMAL HEAD 61
CUTTING BLADE 8
FIG. 9B
FORWARD DIRECTION
Lm
Lm-Ld
12a
12
PRINT AREA
MARK DETECTION BY FORWARD DIRECTION FEEDING
PM
SENSOR UNIT 100
THERMAL HEAD 61
CUTTING BLADE 8
WHEN Lm-Ld IS TOO LARGE AFTER MARK DETECTION, AND REVERSE DIRECTION FEEDING CANNOT BE PERFORMED
FIG. 9C
FORWARD DIRECTION
12
PRINT AREA
PRINT AREA
SENSOR UNIT 100
THERMAL HEAD 61
CUTTING BLADE 8
12a
13a
AS IN THE PAST, FEEDING IS PERFORMED IN THE FORWARD DIRECTION BY Ld+ΔL+Lp, AND THE TIP END IS POSITIONED IN THE CUTTING BLADE POSITION

FIG. 12

ADMISSIBLE DISTANCE TABLE

| | PAPER: SOFT | PAPER: MEDIUM | PAPER: HARD |
|---|---|---|---|
| REMAINING AMOUNT: SMALL | 150mm | 50mm | 20mm |
| REMAINING AMOUNT: MEDIUM | 100mm | 50mm | 20mm |
| REMAINING AMOUNT: LARGE | 50mm | 50mm | 20mm |

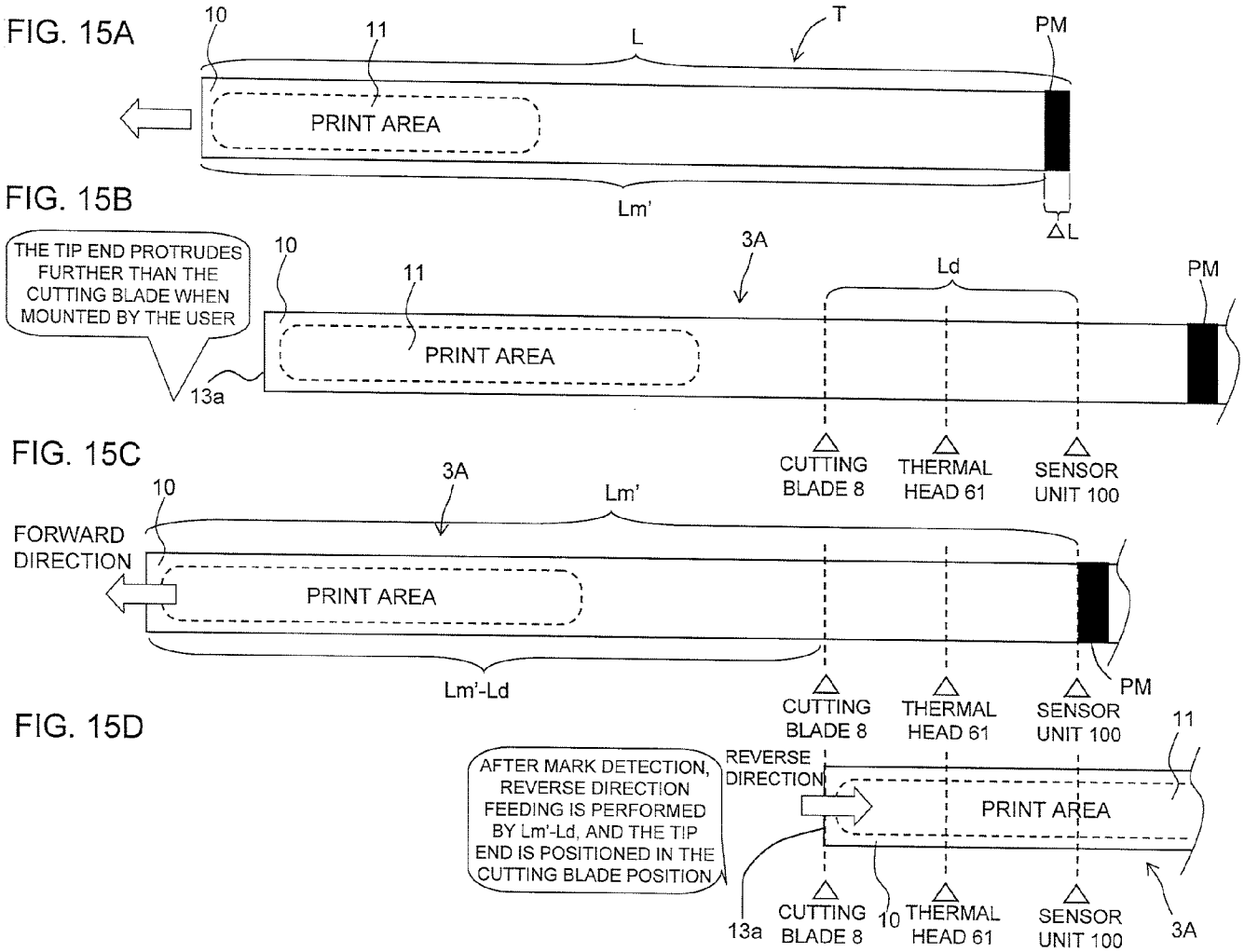
PM
ΔL
T
L
Lm'
11
PRINT AREA
10
FIG. 15A
PM
SENSOR UNIT 100
Ld
THERMAL HEAD 61
CUTTING BLADE 8
3A
11
PRINT AREA
10
13a
THE TIP END PROTRUDES FURTHER THAN THE CUTTING BLADE WHEN MOUNTED BY THE USER
FIG. 15B
PM
SENSOR UNIT 100
THERMAL HEAD 61
CUTTING BLADE 8
Lm'
3A
PRINT AREA
Lm'-Ld
10
FORWARD DIRECTION
FIG. 15C
11
3A
SENSOR UNIT 100
PRINT AREA
THERMAL HEAD 61
10
CUTTING BLADE 8
REVERSE DIRECTION
13a
AFTER MARK DETECTION, REVERSE DIRECTION FEEDING IS PERFORMED BY Lm'-Ld, AND THE TIP END IS POSITIONED IN THE CUTTING BLADE POSITION
FIG. 15D

PRINTER AND RECORDING MEDIUM

CROSS-REFERENCE TO RELATED APPLICATION

The present application claims priority from Japanese Patent Application No. 2013-025201, which was filed on Feb. 13, 2013, the disclosure of which is incorporated herein by reference in its entirety.

BACKGROUND

1. Field

The present disclosure relates to a printer and recording medium that performs desired printing on a print-receiving medium.

2. Description of the Related Art

There are known printers that perform desired printing on a print-receiving medium. In such a printer, an operator mounts a cartridge that stores a print-receiving medium (a cover film and a base tape) on a cartridge holder, and the print-receiving medium supplied from the cartridge is fed. Desired print is formed by printing means (a print head) on the fed print-receiving medium, thereby generating a printed matter (RFID label). To control the positioning of the print-receiving medium along the transport direction when such feeding and a print operation are performed, an identifier (identification mark) for positioning is disposed on the print-receiving medium. This identifier of the print-receiving medium is detected by detecting means (a mark sensor), and the positioning of the print-receiving medium is controlled in accordance with the detection result.

As an example of the positioning control, the initial position when the print processing is started may be set, for example. The cartridge is detachable from the cartridge holder and sometimes removed from the cartridge holder by the operator before the print processing starts. According to such a configuration, the state of the print-receiving medium in the removed cartridge (in other words, the position of the identifier along the transport direction) may be undefined.

Hence, according to the above prior art, after the print processing starts, first the print-receiving medium is fed in the transport direction to control the feeding and print operation with high accuracy, regardless of the state of the print-receiving medium when the cartridge is mounted. Then, once the detecting means detects the identifier, the feeding state at that moment serves as the initial state. Then, the feeding in the transport direction and the control of print formation thereafter are performed using the initial state as reference. Nevertheless, in this case, until feeding is performed when the print processing starts and the identifier is detected as described above, a blank area where print formation is not performed is fed (so-called loading is performed), resulting in waste of the print-receiving medium.

Note that, while the above has been described in connection with an illustrative scenario in which the cartridge that stores the print-receiving medium is detachable from the cartridge holder, the position of the print-receiving medium when not stored is undefined and the same problem may occur even in a configuration where the print-receiving medium wound into a roll shape is stored in storage means of the printer and subsequently used.

SUMMARY

It is therefore an object of the present disclosure to provide a printer and a recording medium capable of preventing waste of a print-receiving medium in a case where positioning control of the print-receiving medium and the like are performed using an identifier for positioning.

In order to achieve the above-described object, according to the present aspect, there is provided a printer comprising a storage device, a feeder, a printing head, an instruction input portion, a first control portion, a detection determining portion, and a second control portion. The storage device detachably stores a print-receiving medium comprising a plurality of identifiers for positioning. The feeder feeds the print-receiving medium stored in the storage device. The printing head performs desired printing on the print-receiving medium fed in a forward direction along a transport direction by the feeder. The detecting device detects the identifier of the print-receiving medium, disposed on a feeding path of the print-receiving medium by the feeder. The instruction input portion inputs an operation instruction for starting print processing. The first control portion controls the feeder so as to start feeding of the print-receiving medium in the forward direction, in accordance with the operation instruction for starting print processing via the instruction input portion. The detection determining portion determines whether or not the detecting device detects the identifier after feeding of the print-receiving medium in the forward direction was started by the first control portion. The second control portion controls the feeder so as to feed the print-receiving medium in a reverse direction that is reverse to the forward direction, and to position a position of the print-receiving medium along the transport direction in a predetermined first initial position in a case that the detection determining portion determined that the detecting device detects the identifier.

BRIEF DESCRIPTION OF THE DRAWINGS

FIG. 6A is an explanatory view showing the positioning control technique of the print-receiving tape in a comparison example in which a blank area where print formation is not performed occurs.

FIG. 6B is an explanatory view showing the positioning control technique of the print-receiving tape in a comparison example in which a blank area where print formation is not performed occurs.

FIG. 6C is an explanatory view showing the positioning control technique of the print-receiving tape in a comparison example in which a blank area where print formation is not performed occurs.

FIG. 9A is an explanatory view showing another example of a positioning technique of the embodiment (a case where reverse direction feeding is not performed).

FIG. 9B is an explanatory view showing another example of a positioning technique of the embodiment (a case where reverse direction feeding is not performed).

FIG. 9C is an explanatory view showing another example of a positioning technique of the embodiment (a case where reverse direction feeding is not performed).

FIG. 12 is an admissible distance table used during positioning control in a modification in which the possibility of reverse direction feeding is determined in accordance with medium type.

FIG. 15A is an explanatory view showing an example of a positioning technique (a case where reverse direction feeding is performed) in a modification in which a mark PM is formed in a transport direction rear end part of the print label T.

FIG. 15B is an explanatory view showing an example of a positioning technique (a case where reverse direction feeding is performed) in a modification in which a mark PM is formed in a transport direction rear end part of the print label T.

FIG. 15C is an explanatory view showing an example of a positioning technique (a case where reverse direction feeding is performed) in a modification in which a mark PM is formed in a transport direction rear end part of the print label T.

FIG. 15D is an explanatory view showing an example of a positioning technique (a case where reverse direction feeding is performed) in a modification in which a mark PM is formed in a transport direction rear end part of the print label T.

DETAILED DESCRIPTION OF THE PREFERRED EMBODIMENT

The following describes an embodiment of the present disclosure with reference to accompanying drawings. This embodiment is an embodiment of a case where the printer of the present disclosure is applied to a label producing apparatus.

General Outer Appearance Configuration

First, the general outer appearance configuration of the label producing apparatus of this embodiment will be described using FIG. 1. Note that the front-rear direction, left-right direction, and up-down direction in the descriptions below refer to the directions of the arrows suitably shown in each figure, such as FIG. 1.

Figure 1:
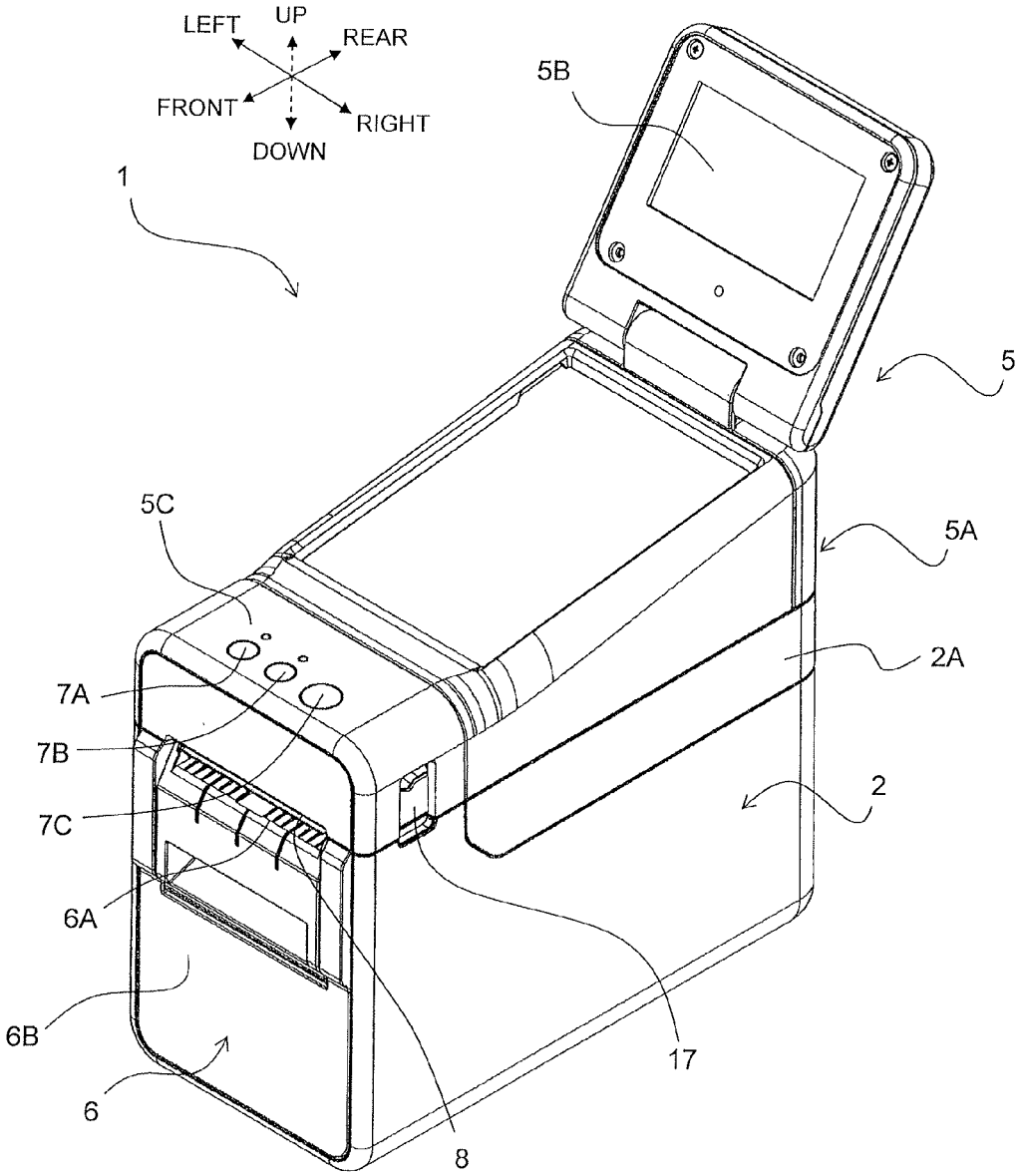
FIG. 1 is a perspective view showing the outer appearance of a label producing apparatus of an embodiment of the present disclosure.

In FIG. 1, the label producing apparatus 1 (equivalent to the printer) comprises a housing 2 comprising a front panel 6, and an upper cover unit 5. The housing 2 and the upper cover unit 5 are made of resin, for example. The upper cover unit 5 comprises a touch panel part 5A, a substantially rectangular-shaped liquid crystal panel part 5B, and an operation button part 5C.

The upper cover unit 5 is pivotably connected to the housing 2 at the rearward end part via a rotating shaft part 2*a* (refer to FIG. 3 described later), forming a structure capable of opening and closing with respect to the housing 2. Note that a housing cover part 2A constituting a part of the above described housing 2 is integrally configured with the lower part of the upper cover unit 5, causing the housing cover part 2A to also open and close in an integral manner during the opening and closing of the upper cover unit 5 (refer to FIG. 2 described later).

The liquid crystal panel part 5B is pivotably connected to the touch panel part 5A at the rearward end part via a rotating shaft part 5*a* (refer to FIG. 3 described later), forming a structure capable of opening and closing with respect to the touch panel part 5A.

The operation button part 5C is disposed on an upper surface position on the frontward side of the upper cover unit 5, and disposes a power supply button 7A of the label producing apparatus 1, a status button 7B for displaying the peripheral device operation status, a label production instruction button 7C, and the like.

A release tab 17 is disposed on both left and right side walls of the housing 2. Pressing this release tab 17 upward releases the locking of the upper cover unit 5 to the housing 2, making it possible to open the upper cover unit 5.

A discharging exit 6A is disposed on the front panel 6, and an opening/closing lid 6B capable of pivoting to the frontward side is disposed below the discharging exit 6A to improve the convenience of installation, paper ejection, and the like of a print-receiving tape 3A described later, for example.

The discharging exit 6A is formed by a front surface upper edge part of the housing 2 and a front surface lower edge part of the above described upper cover unit 5 when the upper cover unit 5 is closed. Note that a cutting blade 8 is disposed on the lower edge inner side of the discharging exit 6A side of the upper cover unit 5, facing downward (refer to FIG. 2, FIG. 3, and the like as well, described later).

Inner Structure

Next, the inner structure of the label producing apparatus 1 of this embodiment will be described using FIG. 2 and FIG. 3.

Figure 2:
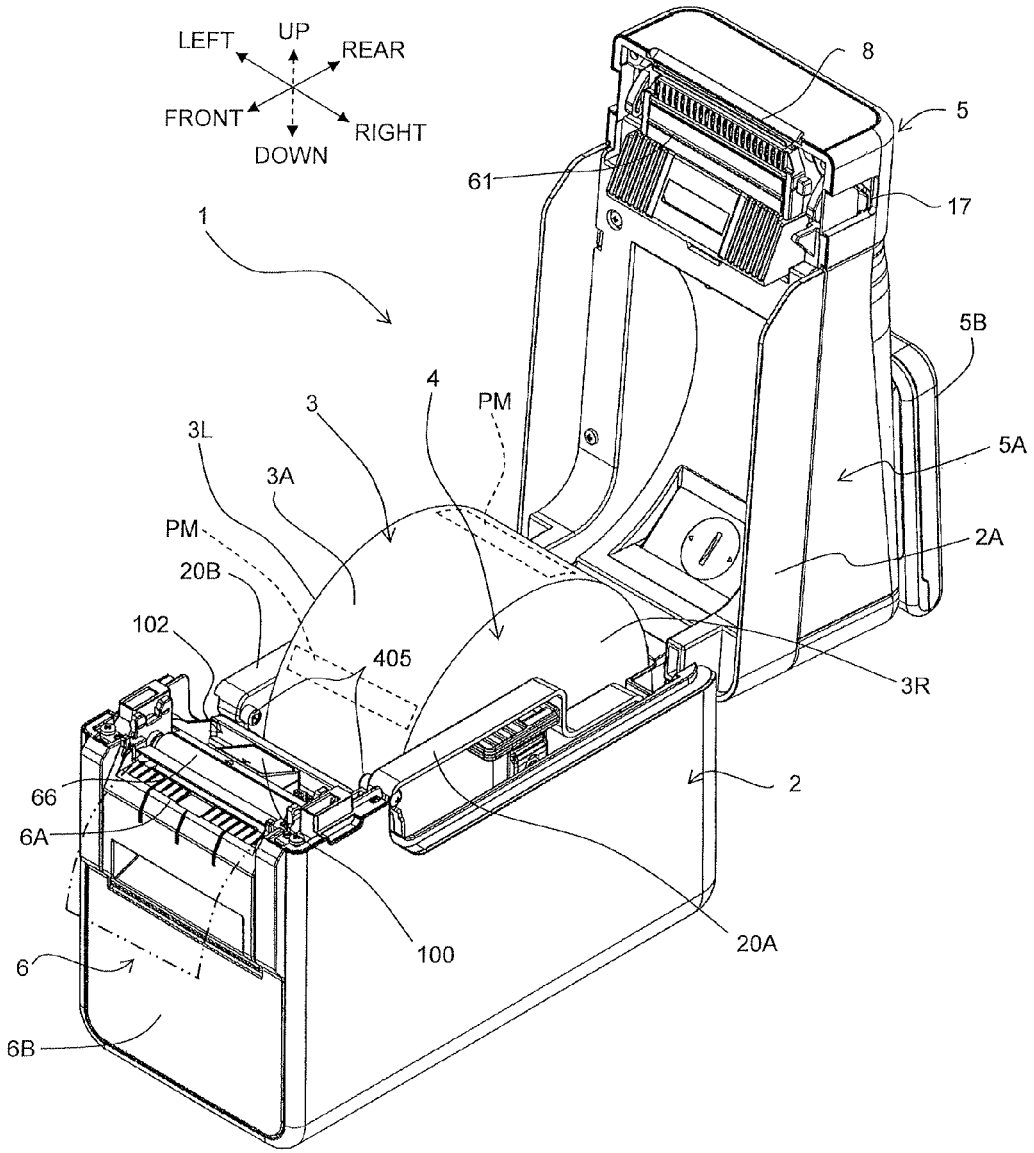
FIG. 2 is a perspective view showing the label producing apparatus with the upper cover unit open and the roll mounted.
Figure 3:
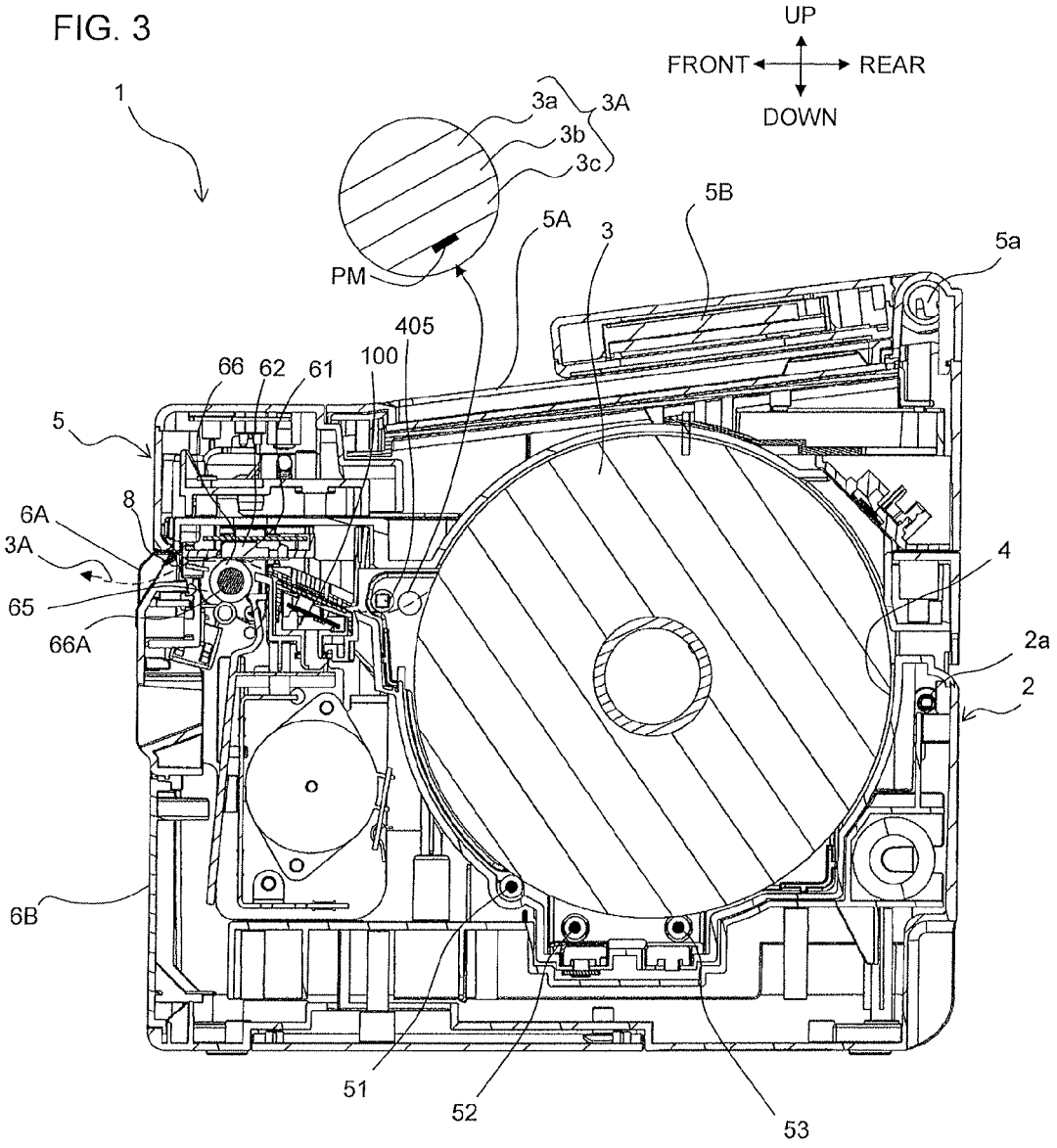
FIG. 3 is a side sectional view showing the overall structure of the label producing apparatus.

As shown in FIG. 2 and FIG. 3, the label producing apparatus 1 comprises a recessed roll storage part 4 (equivalent to the storage part) rearward in the interior space of the housing 2. The roll storage part 4 stores a roll 3 around which is wound the print-receiving tape 3A with a preferred width in a roll shape so that the print-receiving tape 3A (equivalent to the print-receiving medium) is fed out from the roll upper side in this example.

The roll 3 is rotatably stored in the roll storage part 4 with the axis of the winding of the above described print-receiving tape 3A in the left-right direction orthogonal to the front-rear direction.

Print-Receiving Tape

The print-receiving tape 3A is formed into a three-layer structure of a print-receiving layer 3*a*, an adhesive layer 3*b*, and a separation material layer 3*c*, as shown in the enlarged view in FIG. 3. The print-receiving layer 3*a* is a layer on which print is formed by a thermal head 61 (equivalent to the printing part), and is adhered to the separation material layer 3*c* via the adhesive layer 3*b*. A plurality of mark PMs (equivalent to the identifiers) for positioning is disposed at a predetermined interval (equal pitch) along the tape longitudinal direction on the back surface of the separation material layer 3*c* (the face surface of the roll diameter direction inner side). The print-receiving tape 3A wherein printing on the print-receiving layer 3*a* was completed is cut at a predetermined length to generate a print label T (equivalent to the printed matter; refer to FIG. 5 described later) and, in the end, peeled from the separation material layer 3*c* and affixed to an adherent, such as a predetermined good or the like.

Support Rollers

Three support rollers 51-53 are disposed on the bottom surface part of the roll storage part 4. The support rollers 51-53 drivingly rotate and rotatably support the roll 3 by the contact of at least two rollers with the outer peripheral surface of the roll 3 when a platen roller 66 (equivalent to the feeding part) is rotationally driven, pulling out the print-receiving tape 3A from the roll 3. These three support rollers vary in position in the circumferential direction with respect to the roll 3, and are disposed in the order of the first support roller 51, the second support roller 52, and the third support roller 53, along the circumferential direction of the roll 3, from the front toward the rear. The first to third support rollers 51-53 are divided into a plurality of sections in the above described left-right direction (in other words, the roll width direction), and only the sections on which the roll 3 is mounted rotate in accordance with the roll width.

Guide Members

On the other hand, a first guide member 20A that contacts an end surface 3R on the right side of the roll 3 and guides the print-receiving tape 3A in the left-right direction (that is, the tape width direction; hereinafter the same), and a second guide member 20B that contacts an end surface 3L on the left side of the roll 3 and guides the print-receiving tape 3A in the left-right direction are further disposed on the roll storage part 4. The first guide member 20A and the second guide member 20B are capable of moving close to and away from each other by advancing and retreating along the above described left-right direction. Then, the first guide member 20A contacts the roll 3 from the right side and the second guide member 20B contacts the roll 3 from the left side, thereby guiding the print-receiving tape 3A while sandwiching the roll 3 from both sides. Since both of the guide members 20A, 20B are thus disposed in an advanceable and retreatable manner along the left-right direction, both of the guide members 20A, 20B are made to advance and retreat and adjust position in accordance with the width of the stored roll 3, thereby making it possible to sandwich the roll 3 with any width by both of the guide members 20A, 20B and guide the width direction of the print-receiving tape 3A.

Further, a guide protruding part 405 is disposed protruding along the above described left-right direction on the upper part of the frontward side of the guide members 20A, 20B. This guide protruding part 405 contacts and guides a width-direction end part of the print-receiving tape 3A fed out from the roll 3 from above. With this arrangement, it is possible to suppress the flopping of the print-receiving tape 3A in the up-down direction at both end parts of the print-receiving tape 3A fed out from the roll 3 that rotates inside the roll storage part 4.

Sensor Unit

Further, on the frontward side of the roll storage part 4, a sensor disposing part 102, which is a recessed mounting surface, is disposed on the feeding path of the print-receiving tape 3A. A sensor unit 100 (equivalent to the detecting part) for optically detecting the mark PM of the above described print-receiving tape 3A is disposed on this sensor disposing part 102. This sensor unit 100 is held near the tape surface of the print-receiving tape 3A on the transport direction upstream side (the above described rearward side) of the thermal head 61.

The sensor unit 100 is a known transmission-type sensor, for example, comprising a light-emitting part (not shown) and a light-receiving part (not shown). That is, the light emitted from the light-emitting part passes through the print-receiving tape 3A and is received by the light-receiving part. At this time, a difference in the amount of light received by the light receiving part that is equivalent to the amount of light absorbed by the mark PM occurs between locations where the mark PM of the print-receiving tape 3A is disposed and locations where the mark PM is not disposed, and therefore the mark PM is detected as a reference position in the transport direction of the print-receiving tape 3A.

Platen Roller, Thermal Head, and Peripheral Structure Thereof

On the other hand, the above described thermal head 61 is disposed on the front end lower side of the upper cover unit 5, as shown in FIG. 3. Further, the above described platen roller 66 is disposed on the front end upper side of the housing 2, facing this thermal head 61 in the up-down direction. A roller shaft 66A of the platen roller 66 is rotatably supported by a bracket 65 disposed to both axial ends, and a gear (not shown) that drives the platen roller 66 is fixed to one shaft end of the roller shaft 66A.

At this time, the disposed position of the platen roller 66 in the housing 2 corresponds to the installation position of the thermal head 61 in the upper cover unit 5. Then, with the closing of the upper cover unit 5, the print-receiving tape 3A is sandwiched by the thermal head 61 disposed on the upper cover unit 5 side and the platen roller 66 disposed on the housing 2 side, making it possible to perform printing by the thermal head 61. Further, with the closing of the upper cover unit 5, the above described gear fixed to the roller shaft 66A of the platen roller 66 meshes with a gear train (not shown) on the housing 2 side, and the platen roller 66 is rotationally driven by a feeding motor 210 (refer to FIG. 4 described later) comprising a stepping motor or the like. With this arrangement, the platen roller 66 feeds out the print-receiving tape 3A from the roll 3 stored in the roll storage part 4, and the print-receiving tape 3A is fed in a posture in which the tape width direction thereof is in the left-right direction.

The thermal head 61 is fixed to one end of a support member 62 that supports the middle part thereof and is urged downward by a suitable spring member (not shown). The upper cover unit 5 is changed to an open state by the release tab 17, causing the thermal head 61 to separate from the platen roller 66 (refer to FIG. 2). On the other hand, with the closing of the upper cover unit 5, the thermal head 61 presses and urges the print-receiving tape 3A toward the platen roller 66 by the urging force of the spring member, making printing possible.

The above described roll 3 is configured by winding the print-receiving tape 3A into a roll shape so that the print-receiving layer 3*a* is positioned on the outside in the diameter direction. As a result, the print-receiving tape 3A is fed out from the upper side of the roll 3 with the surface of the print-receiving layer 3*a* side facing upward (refer to the wavy line in FIG. 3), and print is formed by the thermal head 61 disposed on the upper side of the print-receiving tape 3A. The cutting blade 8 is used by the operator (user) to cut the print-receiving tape 3A discharged to the outside of the housing 2 via the above described discharging exit 6A at a preferred position.

Overview of Feeding of Print-Receiving Tape

In the above described configuration, when the upper cover unit 5 is closed and the platen roller 66 is rotationally driven by the above described feeding motor 210, the print-receiving tape 3A is pulled. With this arrangement, the print-receiving tape 3A is fed out from the roll 3 while the width direction is guided by the guide member 20A and the guide member 20B.

The print-receiving tape 3A fed out from the roll 3 and fed from the above described rearward side to the above described frontward side (equivalent to the forward direction) is discharged to the outside of the housing 2 from the discharging exit 6A after printing by the thermal head 61. The operator then activates the cutting blade 8 and cuts the print-receiving tape 3A at a preferred length, thereby generating the print label T. Note that FIG. 3 indicates the feeding path of the print-receiving tape 3A fed out and fed from the roll 3 by a dashed line.

Control System

Next, the control system of the label producing apparatus 1 will be described using FIG. 4.

Figure 4:
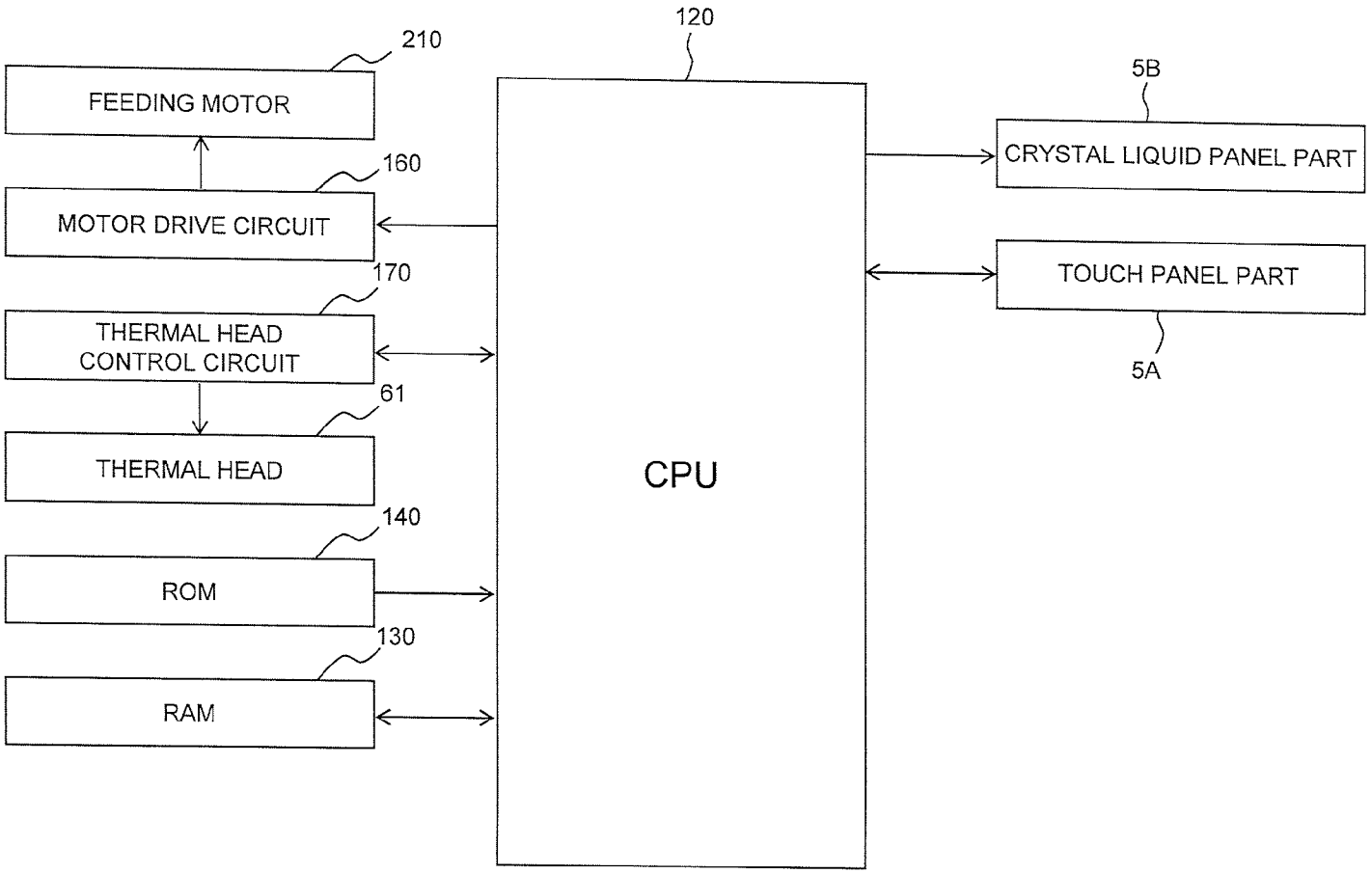
FIG. 4 is a functional block diagram showing the control system of the label producing apparatus.

In FIG. 4, the label producing apparatus 1 comprises a CPU 120 that constitutes calculating device that performs predetermined calculations. The CPU 120 performs signal processing in accordance with a program stored in advance in a ROM 140 while utilizing the temporary storage function of a RAM 130, and controls the entire label producing apparatus 1 accordingly. The above described liquid crystal panel part 5B, the above described touch panel part 5A, the above described RAM 130, and the ROM 140 (equivalent to the recording medium) are connected to the CPU 120. The ROM 140 stores a control program for executing various processing such as label production processing and the like, and an admissible distance table (refer to FIG. 12 described later) described later. The RAM 130 temporarily stores print data entered via the touch panel part 5A, and print data entered in a wired or wireless manner from an external terminal, such as a personal computer. The CPU 120 is connected to a motor driving circuit 160 that controls the drive of the above described feeding motor 210 that drives the above described platen roller 66, and a thermal head control circuit 170 that controls the conduction of heating elements of the above describe thermal head 61.

The operator can operate the touch panel part 5A to enter desired print data. Further, desired print data entered using an external input terminal such as a personal computer or the like connected in a wired or wireless manner to the label producing apparatus 1 can be received and obtained from the input terminal.

Special Characteristics of this Embodiment

Hence, the most special characteristic of this embodiment lies in the prevention of waste that results from the occurrence of the blank area (details described later) where print formation is not performed according to the distance between the thermal head 61 and the sensor unit 100 disposed along the feeding path of the print-receiving tape 3A when positioning of the print-receiving tape 3A is performed by detection of the above described mark PM by the sensor unit 100. In the following, details on the functions will be described in order.

Figure 5:
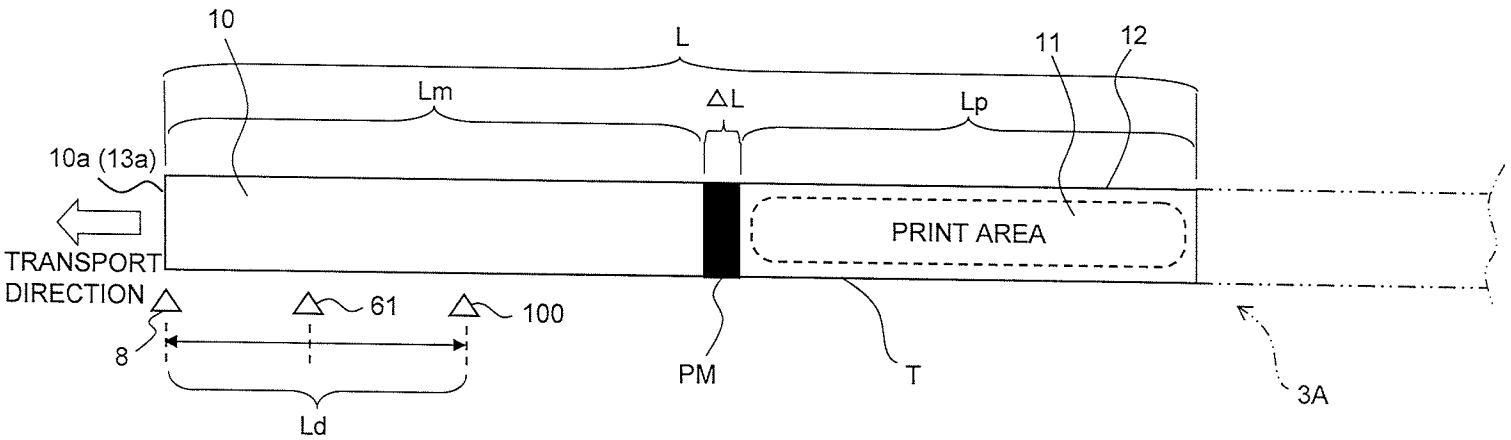
FIG. 5 is a conceptual explanatory view showing the dimensional relationship between the print-receiving tape and each print label area.

The print label T is generated by performing desired printing on the print-receiving tape 3A, which is fed out from the roll 3 of the roll storage part 4 and fed from the rear to the front, by the thermal head 61, and cutting the rear end position by the cutting blade 8, as shown in FIG. 5.

According to this embodiment, the above described mark PM of a transport direction length ΔL is disposed on the back surface side of the print label T of a total length L as shown in the figure (the face surface and the back surface are conceptually shown on the same side for convenience of explanation in FIG. 5; hereinafter the same). At this time, the positions of the plurality of the above described marks PM of the print-receiving tape 3A are set in advance so that the mark PM is positioned in the length direction substantial center part of the print label T. A frontward area 10 (a non-print area in this example) of a transport direction length Lm is disposed on the transport direction downstream side (the above described frontward side) of the mark PM on the front surface side of the print-receiving tape 3A. A rearward area 12 of a transport direction length Lp, which includes a print area 11 where print formation is performed by the thermal head 61, is disposed on the transport direction upstream side (the above described rearward side) of the mark PM on the front surface side of the print-receiving tape 3A. That is, in this example, the total length L of the print label T is L=Lm+ΔL+Lp. Further, in this example, with the sensor unit 100, the thermal head 61, and the cutting blade 8 disposed in that order toward the above described frontward side along the tape transport direction, the distance from the most upstream sensor unit 100 to the most downstream cutting blade 8 is Ld.

Then, the mark PM is detected by the sensor unit 100 when the feeding and print operation are performed as previously described, and is thus used for controlling the positioning along the transport direction of the print-receiving tape 3A. In this example, a state in which a tape tip end 13*a* of the print-receiving tape 3A (a tip end 10*a* of the frontward area 10) is in a cutting blade position facing the cutting blade 8 is set as the initial position of the print-receiving tape 3A. According to the above described positioning control, as a basic setting, the print-receiving tape 3A is positioned in the initial position at the start of production of the print label T (that is, when printing starts).

Positioning Technique According to Comparison Example

The following describes a comparison example similar to the prior art in which the above described blank area where print formation is not performed occurs, using FIGS. 6A-6C. After print formation is performed on the print-receiving tape 3A pulled out from the roll 3, the rear end part is cut as previously described, thereby generating the above described print label T. Accordingly, when production of the next print label T starts, the position of the tip end 13*a* of the print-receiving tape 3A should be in the above described cutting blade position if the print-receiving tape 3A is left as is. Nevertheless, after generation of the print label T as described above, the roll 3 may be removed from the roll storage part 4 by the operator, for example, and subsequently further remounted to the roll storage part 4, or the like. In such a case, depending on the handling by the operator, the roll 3 may conceivably be mounted to the roll storage part 4 with the tape tip end 13*a* of the pulled out print-receiving tape 3A protruding further on the frontward side than the above described cutting blade position that faces the cutting blade 8, as shown in FIG. 6A. Or, even when the roll 3 is newly mounted to the roll storage part 4, the roll 3 may be conceivably mounted with the tape tip end 13*a* protruding similar to the above, depending on the handling by the operator.

Hence, in this comparison example, after the roll 3 is mounted as in the above described FIG. 6A, the aforementioned feeding of the print-receiving tape 3A for reliably achieving a state (initial position) in which the tape tip end 13*a* is positioned in the above described cutting blade position (for so-called loading) is performed. That is, the print-receiving tape 3A is fed frontward (in the forward direction) by the drive of the platen roller 66. Then, when the mark PM arrives at the position of the sensor unit 100 and the sensor unit 100 detects the mark PM (refer to FIG. 6B), the print-receiving tape 3A is subsequently further fed in the forward direction by a distance (Ld+ΔL+Lp), as shown in FIG. 6C. With this arrangement, due to the dimensional relationship described in the above described FIG. 5, the feeding of the print-receiving tape 3A stops at the moment that the area corresponding to the rear end 12*a* of the rearward area 12 of the print label T moves to the above described cutting blade position.

In this feeding stopped state, the print-receiving tape 3A is cut by the cutting blade 8. With this arrangement, the tape tip end 13*a* of the following print-receiving tape 3A is positioned in the above described cutting blade position. As a result, the (above described following) print-receiving tape 3A is accurately positioned, and thus thereafter preferred print formation is performed in the above described print area 11 by the thermal head 61 while the print-receiving tape 3A is fed in the feeding direction using this positioned state as reference. Then, feeding is stopped at the moment that the area corresponding to the above described rear end 12*a* arrives at the above described cutting blade position, and the print-receiving tape 3A is cut at the rear end 12*a*, thereby generating the print label T.

As previously described, according to the technique by this comparison example, due to the forward direction feeding of the distance (Ld+ΔL+Lp) after the mark PM is detected by the sensor unit 100 as shown in FIG. 6B, the print-receiving tape 3A of a length equivalent to one print label T is simply fed as is in a blank state in which print formation is not performed (without being used for producing the print label T), resulting in waste, as shown in FIG. 6C.

Example of Positioning Technique According to the Embodiment

An example of a positioning technique executed in this embodiment will now be described using FIG. 7. According to this embodiment, to eliminate the waste such as in the above described comparison example, the print-receiving tape 3A is positioned in the above described initial position by being fed in the reverse direction (rearward) reverse to the above described forward direction (hereinafter suitable referred to as "reverse feeding"). That is, in the same manner as previously described, after the roll 3 is mounted with the tape tip end 13*a* protruding further toward the frontward side than the above described cutting blade position (refer to FIG. 7A), the print-receiving tape 3A is fed frontward (in the forward direction). Then, when the mark PM is detected by the sensor unit 100 (refer to FIG. 7B), the feeding in the forward direction by the platen roller 66 is stopped.

At the above described moment that the feeding is stopped, the amount of frontward protrusion of the print-receiving tape 3A from the cutting blade position is an amount equivalent to the length of a distance (Lm−Ld). Hence, the platen roller 66 is driven in the direction reverse to the driving during the above described forward direction feeding, and stops at the moment that the print-receiving tape 3A is fed by a distance (Lm−Ld) in the above described reverse direction toward the rear (hereinafter the fed distance during rearward feeding is suitably referred to as "reverse distance"), as shown in FIG. 7C. With this arrangement, the tape tip end 13*a* of the print-receiving tape 3A is accurately positioned in the above described cutting blade position (equivalent to the first initial position).

Figure 8:
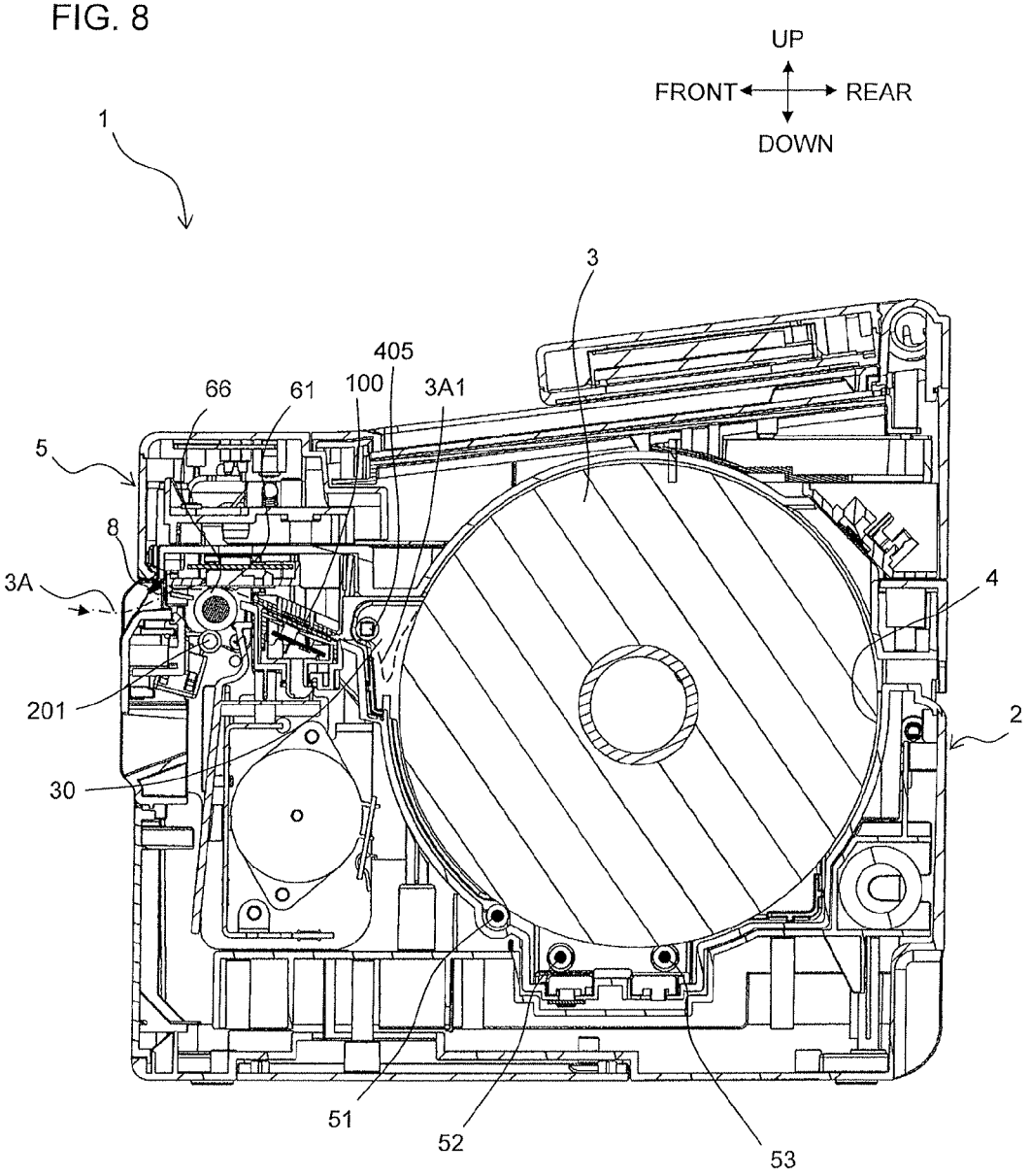
FIG. 8 is an explanatory view showing bending of the print-receiving tape inside the roll storage part during positioning control by reverse direction feeding.

At this time, reverse direction feeding is performed as described above, thereby housing a part of the print-receiving tape 3A equivalent to a length of 50 mm, which corresponds to the above described reverse distance (Lm−Ld), in an empty space 30 formed between the frontward side of the roll 3 and the guide protrusion 405 further frontward therefrom inside the roll storage part 4 while forming a small bending part 3A1, as shown in FIG. 8. With this arrangement, the print-receiving tape 3A is absorbed inside the roll storage part 4 without causing a paper jam, feeding error, or the like.

Then, thereafter, desired print formation is performed while feeding the print-receiving tape 3A in the feeding direction using this positioned state as reference in the same manner as described above, and the print-receiving tape 3A is cut at the above described rear end 12*a*, thereby generating the print label T.

Another Example of Positioning Technique According to the Embodiment

In the aforementioned example, the aforementioned reverse direction feeding can be performed without causing a paper jam or the like, as shown in FIG. 8, for example. Yet, conversely, depending on the feeding state and the like of the print-receiving tape 3A immediately prior to this, unfavorable cases in which a paper jam or abnormal feeding occurs when reverse direction feeding is performed in the same manner as described above may occur.

Figure 7A:
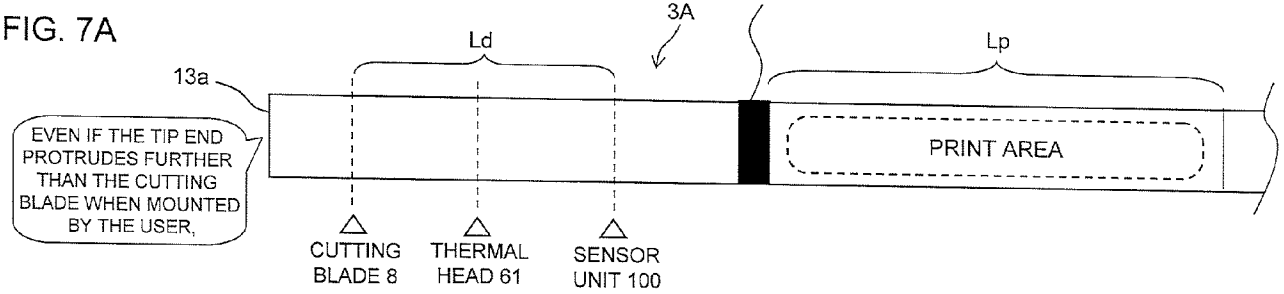
FIG. 7A is an explanatory view showing an example of a positioning technique of the embodiment (a case where reverse direction feeding is performed).
Figure 7B:
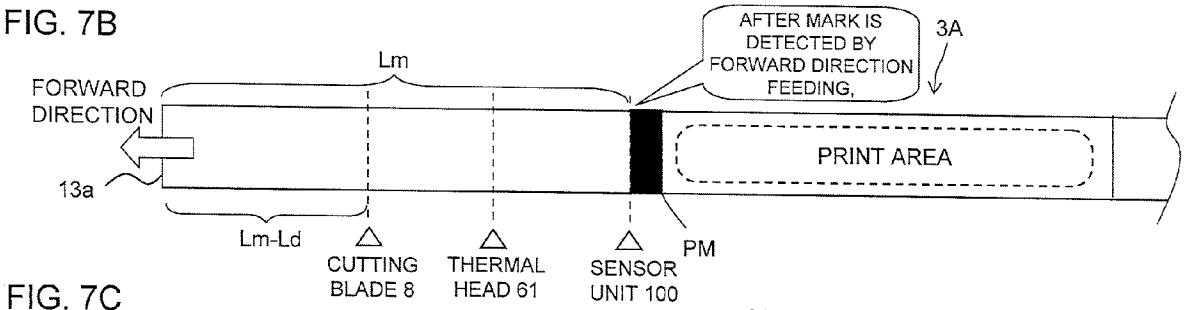
FIG. 7B is an explanatory view showing an example of a positioning technique of the embodiment (a case where reverse direction feeding is performed).
Figure 7C:
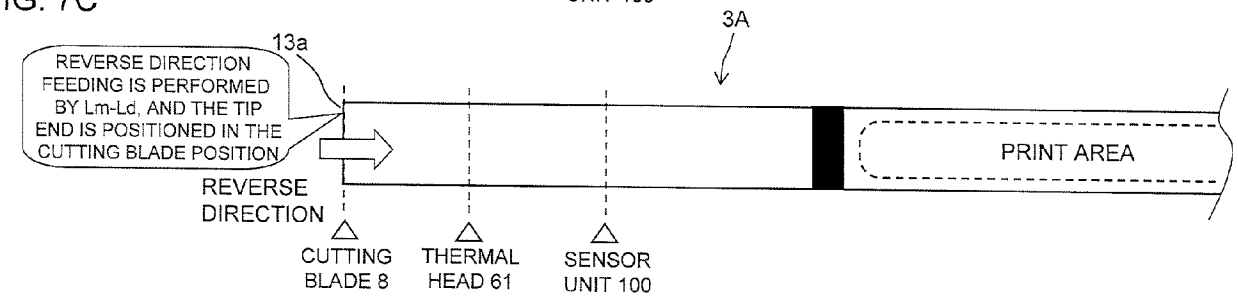
FIG. 7C is an explanatory view showing an example of a positioning technique of the embodiment (a case where reverse direction feeding is performed).

Hence, according to this embodiment, in such a case as described above, positioning by forward direction feeding in the same manner as the above described comparison example is performed without performing the reverse direction feeding such as shown in the above described FIGS. 7A-7C. That is, first, as shown in FIG. 9A, after the roll 3 is mounted with the tape tip end 13*a* protruding further toward the frontward side than the above described cutting blade position in the same manner as previously described, the print-receiving tape 3A is fed frontward (in the forward direction). Then, when the mark PM is detected by the sensor unit 100 (refer to FIG. 9B), the feeding in the forward direction is stopped. At this time, in a case where the frontward protruding distance of the above described print-receiving tape 3A from the cutting blade position (Lm−Ld) is too long compared to the aforementioned empty space 30, there is concern that a paper jam, abnormal feeding, or the like may occur when reverse direction feeding is performed in the same manner as described above. Or, a similar concern may arise depending on the material of the print-receiving tape 3A as well (in a case where the material is relatively hard, for example; refer to the modification of (1) described later).

Hence, in this case, the reverse direction feeding of the print-receiving tape 3A is not performed even after the above described stopping of the feeding, and a control technique similar to the comparison example shown in the above described FIG. 6C is used. That is, as shown in FIG. 9C, the print-receiving tape 3A is further fed in the forward direction by a distance (Ld+ΔL+Lp). With this arrangement, the area corresponding to the above described rear end 12*a* arrives at the above described cutting blade position, and the feeding of the print-receiving tape 3A stops. In this feeding stopped state, the print-receiving tape 3A is cut by the cutting blade 8, thereby positioning the tape tip end 13*a* of the following print-receiving tape 3A in the above described cutting blade position (equivalent to the second initial position). With this arrangement, the (above described following) print-receiving tape 3A is accurately positioned.

Note that, according to this embodiment, the assessment of whether to drive the feeding as shown in the above described FIG. 7 or not drive the feeding as shown in FIG. 9 is determined by whether or not a predetermined reverse ability condition (details described later) defined in advance is satisfied. This determination is made based on medium information (described later) of the print-receiving tape 3A entered by the operator.

Control Steps

Figure 10:
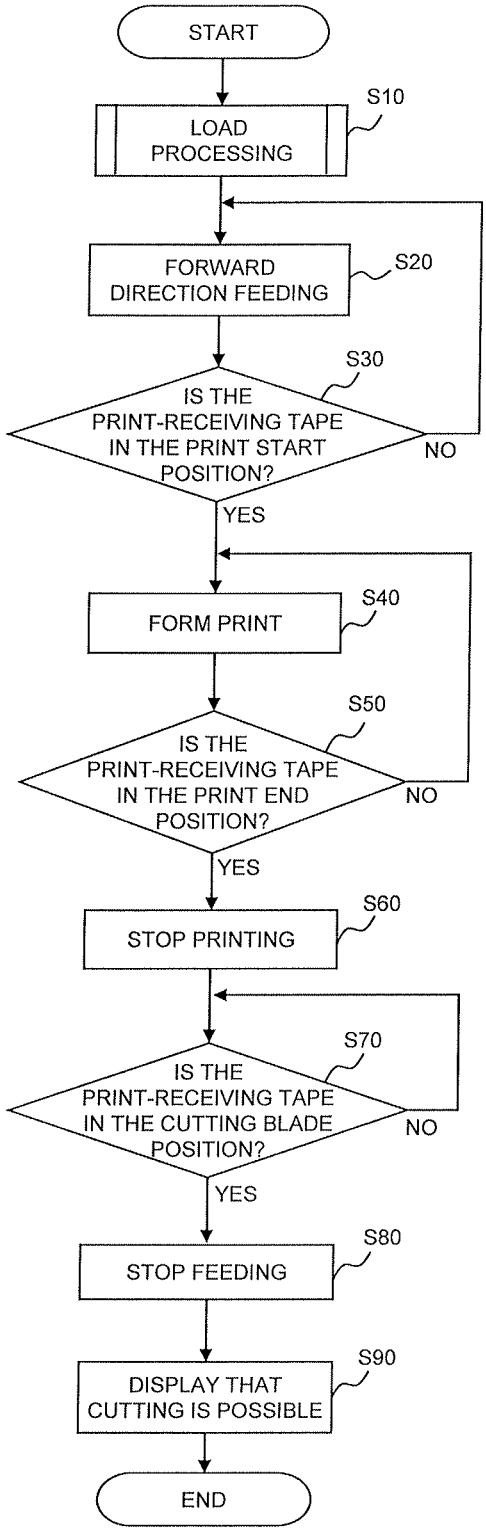
FIG. 10 is a flowchart showing the control steps executed by the CPU during label production.

The following describes the processing steps executed by the CPU 120 during label production processing in order to achieve the above described technique of this embodiment, using the flowchart of FIG. 10. The flow shown in FIG. 10 starts by the operator turning ON the power supply of the label producing apparatus 1 by the power supply button 7A, for example.

In FIG. 10, first, in step S10, the CPU 120 executes the load processing for positioning the print-receiving tape 3A. The load processing of step S10 will be described using FIG. 11 described later. When step S10 ends, the flow proceeds to step S20.

In step S20, the CPU 120 outputs a control signal to the above described motor driving circuit 160, thereby causing the above described feeding motor 210 to drive the platen roller 66 and feed the print-receiving tape 3A in the forward direction. Subsequently, the flow proceeds to step S30.

In step S30, the CPU 120 determines whether or not the print-receiving tape 3A arrived at the print start position of the thermal head 61 (whether or not the print-receiving tape 3A was fed to the position corresponding to the transport direction front end position of the print area 11 of the above described print label T so that the thermal head 66 faces the print-receiving tape 3A) by a known technique. Note that this determination may be made by determining whether or not feeding was performed by a predetermined distance defined in advance from the start of the tape feeding of the forward direction feeding of step S10, for example. Determination of the predetermined distance need only be made by counting the pulse count output by the motor driving circuit 160 that drives the feeding motor 210, which is a pulse motor, after the timing of the above described step S20, and detecting whether or not the pulse count has reached a predetermined value corresponding to the above described predetermined distance, for example. Or, the determination may be made by determining if a predetermined time period elapsed since the start of the tape feeding of the above described forward direction feeding. Until the print-receiving tape 3A arrives at the print start position, the condition is not satisfied (S30: NO), the flow returns to the above described step S20, and the same step is repeated. Once the print-receiving tape 3A arrives at the print start position, the condition is satisfied (S30: YES) and the flow proceeds to step S40.

In step S40, the CPU 120 outputs a control signal to the above described thermal head control circuit 170, thereby controlling the conduction of the heating elements of the thermal head 61. With this arrangement, print formation on the print-receiving tape 3A in accordance with the print data entered by the operator via the touch panel part 5A or the above described print data entered via an external terminal, such as a PC or the like, is started. Subsequently, the flow proceeds to step S50.

In step S50, the CPU 120 determines whether or not the transport direction position of the print-receiving tape 3A arrived at the print end position corresponding to the above described print data, by a known technique. If the transport direction position has not arrived at the print end position, the condition is not satisfied (S50: NO), the flow returns to the above described step S40, and the same step is repeated. If the transport direction position has arrived at the print end position, the condition is satisfied (S50: YES), and the flow proceeds to step S60.

In step S60, the CPU 120 outputs a control signal to the above described thermal head control circuit 170, and stops conduction to the heating elements of the thermal head 61. With this arrangement, the printing on the print-receiving tape 3A by the thermal head 61 stops. Subsequently, the flow proceeds to step S70.

In step S70, the CPU 120 determines whether or not the print-receiving tape 3A was fed to the extent that the area corresponding to the rear end 12*a* of the rearward area 12 of the above described print label T of the print-receiving tape 3A arrives at the above described cutting blade position, by a known technique. Until the area arrives at the above described cutting blade position, the condition is not satisfied (S70: NO), and the flow loops back and enters a standby state. Once the area arrives at the above describe cutting position, the condition of step S70 is satisfied (S70: YES), and the flow proceeds to step S80.

In step S80, the CPU 120 outputs a control signal to the above described motor driving circuit 160, the above described feeding motor 210 stops the driving of the platen roller 66, and the feeding of the print-receiving tape 3A (the feeding in the forward direction) stops. With this arrangement, the area of the print-receiving tape 3A corresponding to the rear end 12*a* of the rearward area 12 of the above described print label T stops at the above described cutting blade position facing the cutting blade 8. Subsequently, the flow proceeds to step S90.

In step S90, the CPU 120 outputs a control signal to the liquid crystal panel part 5B, and the liquid crystal panel part 5B displays that the print-receiving tape 3A can be cut. The operator, at this point in time, can view the display of the liquid crystal panel part 5B and cut the print-receiving tape 3A at a position corresponding to the rear end 12*a* of the rearward area 12 of the above described print label T by a manual operation using the cutting blade 8, thereby generating the print label T. When step S90 ends, this flow is terminated.

Load Processing

Figure 11:
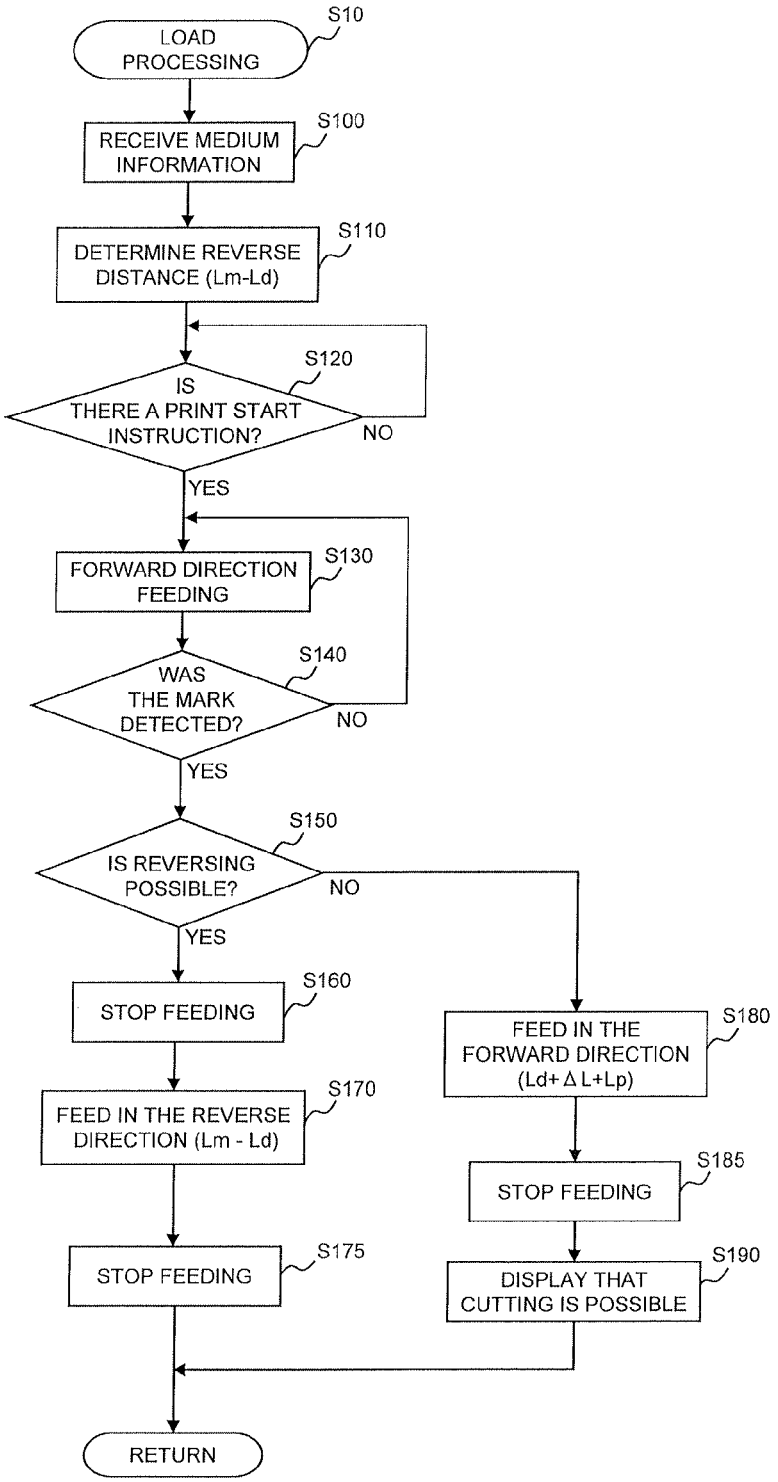
FIG. 11 is a flowchart showing the detailed steps for the load processing of step S10.

The detailed steps of the load processing of the above described step S10 will now be described using FIG. 11. In FIG. 11, first, in step S100, the CPU 120 receives the medium information of the print-receiving tape 3A via an operation of the touch panel part 5A or an operation terminal such as a PC by the operator. This medium information includes, for example, the disposed mode of the mark PM of the print-receiving tape 3A (the values of Lm, Lp, and ΔL, for example, in the aforementioned example). Other than the disposed mode, the medium information may also include the thickness, material, and the like of the print-receiving tape 3A (refer to the modification of (1) described later). Subsequently, the flow proceeds to step S110.

In step S110, the CPU 120 determines the above described reverse distance of the print-receiving tape 3A based on the above described medium information received in the above described step S120. That is, when the print-receiving tape 3A is fed in the reverse direction, the above described reverse distance that the print-receiving tape 3A should be fed in the reverse direction differs according to the disposed mode of the mark PM of the print-receiving tape 3A. That is, as previously described, in a case where a plurality of the marks PM is disposed at an equal pitch and the fixed-length print label T comprising one mark PM is produced, the above described reverse distance increases in proportion to the length of the above described pitch. Further, the above described reverse distance also differs depending on if the mark PM is formed in the transport direction middle part of the fixed-length print label T as described above, formed in the rear end part of the fixed-length print label T (refer to the modification of FIG. 15 described later), or formed in the front end part (tip end part) of the fixed-length print label T. Hence, in this step S110, the above described reverse distance (the distance (Lm−Ld) in the above described example) is calculated based on the disposed mode of the above described mark PM included in the medium information entered in the above described step S100. Note that, at this time, the value of the above described distance Ld is structurally uniquely defined as a value specific to the label producing apparatus 1, and is stored in the above described ROM 140 in advance, for example.

Subsequently, in step S120, the CPU 120 determines whether or not there was a print start instruction. Until the operator performs an instruction operation for label production via the label production instruction button 7C (or an operation terminal such as a PC), the condition is not satisfied (step S120: NO), and the flow loops back and enters a standby state. When the above described production instruction operation is performed, the condition is satisfied (step S120: YES), and the flow proceeds to step S130.

In step S130, the CPU 120 outputs a control signal to the above described motor driving circuit 160, and the above described feeding motor 210 drives the platen roller 66 and starts feeding the print-receiving tape 3A to the frontward side (in the forward direction). Subsequently, the flow proceeds to step S140.

In step S140, the CPU 120 determines whether or not the mark PM was detected by the sensor unit 100 based on the detection signal from the sensor unit 100. While the mark PM is not detected, the condition is not satisfied (step S140: NO), the flow returns to the above described step S130, and the same step is repeated. In a case where the mark PM is detected, the condition is satisfied (step S140: YES), and the flow proceeds to step S150.

In step S150, the CPU 120 determines whether or not the above described reverse feeding of the print-receiving tape 3A is possible. Specifically, the CPU 120 determines whether or not the predetermined reversability condition defined in advance is satisfied based on the reverse distance (Lm−Ld) determined in the above described step S110. In this example, the above described reverse distance being less than or equal to the predetermined admissible distance (a fixed defined value in this example; 100 mm, for example) is set in advance as the above described reversability condition. Accordingly, in a case where the above described reverse distance (Lm−Ld) is less than or equal to the above described admissible distance, (the reversability condition is satisfied,) the condition of step S150 is satisfied (step S150: YES), and the flow proceeds to step S160. In a case where the above described reverse distance (Lm−Ld) is longer than the above described admissible distance, (the reversability condition is not satisfied,) the condition of step S150 is not satisfied (step S150: NO), and the flow proceeds to step S180 described later.

In step S160, the CPU 120 outputs a control signal to the above described driving circuit 160, the above described feeding motor 210 stops driving the platen roller 66, and the frontward feeding (in the forward direction) of the print-receiving tape 3A stops. Subsequently, the flow proceeds to step S170.

In step S170, the CPU 120 outputs a control signal to the above described motor driving circuit 160, the above described feeding motor 210 drives the platen roller 66 in the reverse direction, and the print-receiving tape 3A is fed in the reverse direction by a reverse distance (Lm−Ld) determined in the above described step S110. Subsequently, the flow proceeds to step S175.

In step S175, the CPU 120 outputs a control signal to the above described driving circuit 160, and the above described feeding motor 210 stops driving the platen roller 66. With this arrangement, the reverse direction feeding of the print-receiving tape 3A stops, and the tape tip end 13*a* of the print-receiving tape 3A is positioned in the above described first initial position in which it arrived at the above described cutting blade position. When step S175 ends, this routine is terminated and the flow returns to the above described step S20 of the above described FIG. 10.

On the other hand, in step S180, the CPU 120 outputs a control signal to the above described motor driving circuit 160, the above described feeding motor 210 drives the platen roller 66, and the feeding of the print-receiving tape 3A is continued. Then, the print-receiving tape 3A is further fed in the forward direction by a distance (Ld+ΔL+Lp) from the position where the mark PM was detected in the above described step S140. Subsequently, the flow proceeds to step S185.

In step S185, the CPU 120 outputs a control signal to the above described driving circuit 160, and the above described feeding motor 210 stops driving the platen roller 66. With this arrangement, the forward direction feeding of the print-receiving tape 3A stops, and the print-receiving tape 3A is positioned in the aforementioned second initial position (the tape tip end 13*a* newly formed by the cutting in step S190 described later is in the cutting blade position).

Subsequently, in step S190, the CPU 120, similar to the above described step S90, outputs a control signal to the liquid crystal panel part 5B and displays that the print-receiving tape 3A can be cut. With this arrangement, the operator can cut the print-receiving tape 3A by a manual operation using the cutting blade 8. When step S190 ends, this routine is terminated and the flow returns to the above described step S20 of the above described FIG. 10.

Note that, in the above described flow, the CPU 120 that executes step S100 functions as the information input part described in the claims, the CPU 120 that executes step S110 functions as the reverse distance determining part described in the claims, and the CPU 120 that executes step S120 functions as the instruction input part described in the claims. Further, the CPU 120 that executes step S130 functions as the first control part described in the claims, and the CPU 120 that executes step S140 functions as the detection determining part described in the claims. Furthermore, the CPU 120 that executes step S150 functions as the reverse determining part described in the claims, the CPU 120 that executes step S170 functions as the second control part described in the claims, and the CPU 120 that executes step S180 functions as the third control part described in the claims.

Note that the present disclosure is not limited to the above described embodiment, and various modifications may be made without deviating from the spirit and scope of the disclosure. The following describes such modifications one by one.

(1) When Determining Whether or not Reverse Direction Feeding is Possible in Accordance with Medium Type In the above described embodiment, whether or not reverse direction feeding of the print-receiving tape 3A is possible during positioning control was determined by whether or not the reversability condition that the reverse distance (=Lm−Ld) is less than or equal to the above described admissible distance is satisfied, and the above described admissible distance at that time was a fixed value (of 100 mm or the like, for example). Nevertheless, the admissible distance is not limited to such a fixed value, allowing the admissible distance to be variable in accordance with the medium type of the print-receiving tape 3A (in particular, a soft type, a medium type, or a hard type of paper, in this example; details described later), and in accordance with the medium type in terms of the remaining amount of the print-receiving tape 3A inside the roll storage part 4, or the like. In this case, whether or not reverse direction feeding of the print-receiving tape 3A is possible is determined by comparing the variable admissible distance and the above described calculated reverse distance. Such a modification will now be described using FIGS. 12-14.

Admissible Distance Table

In this modification, the above described admissible distance is variably determined in accordance with the paper and remaining amount of the print-receiving tape 3A using the admissible distance table (stored in the ROM 140, for example) shown in FIG. 12. That is, when the reverse direction feeding of the print-receiving tape 3A is performed as previously described, the admissible distance that is admissible on the system side without causing a feeding error, medium jam, or the like on the label producing apparatus 1 side may differ according to the remaining amount and material of the print-receiving tape 3A. In a case where the print-receiving tape 3A is pulled and fed out from the roll 3 by the platen roller 66, the outer diameter of the roll 3 decreases in proportion to the decrease in remaining amount, increasing the above described empty space 30 of the roll storage part 4. Accordingly, in this case, even if the print-receiving tape 3A of a relatively long distance is fed in reverse, a feeding error and paper jam do not occur, that is, the above described admissible distance increases. Conversely, the roll outer diameter increases in proportion to the increase in the remaining amount of the print-receiving tape 3A, decreasing the above described admissible distance.

Further, in a case where the material of the print-receiving tape 3A is relatively soft, a relatively long print-receiving tape 3A is readily stored while being suitably bent inside the empty space 30 of the roll storage part 4, even if fed in the reverse direction. Accordingly, in this case, even if the print-receiving tape 3A of a relatively long distance is fed in reverse, a feeding error and paper jam do not occur, that is, the above described admissible distance increases. Conversely, the above described bending occurs less readily in proportion to the hardness of the material of the print-receiving tape 3A, more readily causing feeding errors and paper jams, and therefore the above described admissible distance decreases.

Based on the above, in FIG. 12, the admissible distance table determines the value of the above described admissible distance in accordance with the combinations of each of the three types of the print-receiving tape, namely a soft paper type, a medium paper type, and a hard paper type, and the remaining amount (small, medium, large) of the print-receiving tape 3A of the roll 3 inside the roll storage part 4, in this example.

As shown in the table, in a case where a soft paper type is used as the print-receiving tape 3A, the admissible distance is determined to be 150 mm in a case where the remaining amount inside the roll storage part 4 is relatively small (since the above described space 30 is relatively wide), 100 mm in a case where the remaining amount inside the roll storage part 4 is medium, and 50 mm in a case where the remaining amount inside the roll storage part 4 is relatively large (since the above described empty space 30 is relatively narrow).

Similarly, in a case where a medium paper type is used as the print-receiving tape 3A, the admissible distance is determined to be 50 mm in a case where the remaining amount inside the roll storage part 4 is relatively small, 50 mm in a case where the remaining amount inside the roll storage part 4 is medium, and 20 mm in a case where the remaining amount inside the roll storage part 4 is relatively large.

Similarly, in a case where a hard paper type is used as the print-receiving tape 3A, the admissible distance is determined to be 20 mm in all cases including the case where the remaining amount inside the roll storage part 4 is relatively small, the case where the remaining amount inside the roll storage part 4 is medium, and the case where the remaining amount inside the roll storage part 4 is relatively large (since this type is presumably more difficult to bend than the above described soft type, for example).

Note that the type of the print-receiving tape 3A is identified based on an operation input of the operator as previously described (see step S100 of FIG. 14 described later). Further, the remaining amount of the print-receiving tape 3A need only be obtained by a known technique, such as providing an optical sensor inside the roll storage part 4 to measure the diameter of the roll 3, providing a weighing device to measure the weight of the roll 3, or counting the number of print labels T produced from the print-receiving tape 3A.

Note that, in a case where a print-receiving tape 3A with a constantly fixed material is used, it is possible to use the admissible distance with only the remaining tape amount as the reversability condition.

Figure 13:
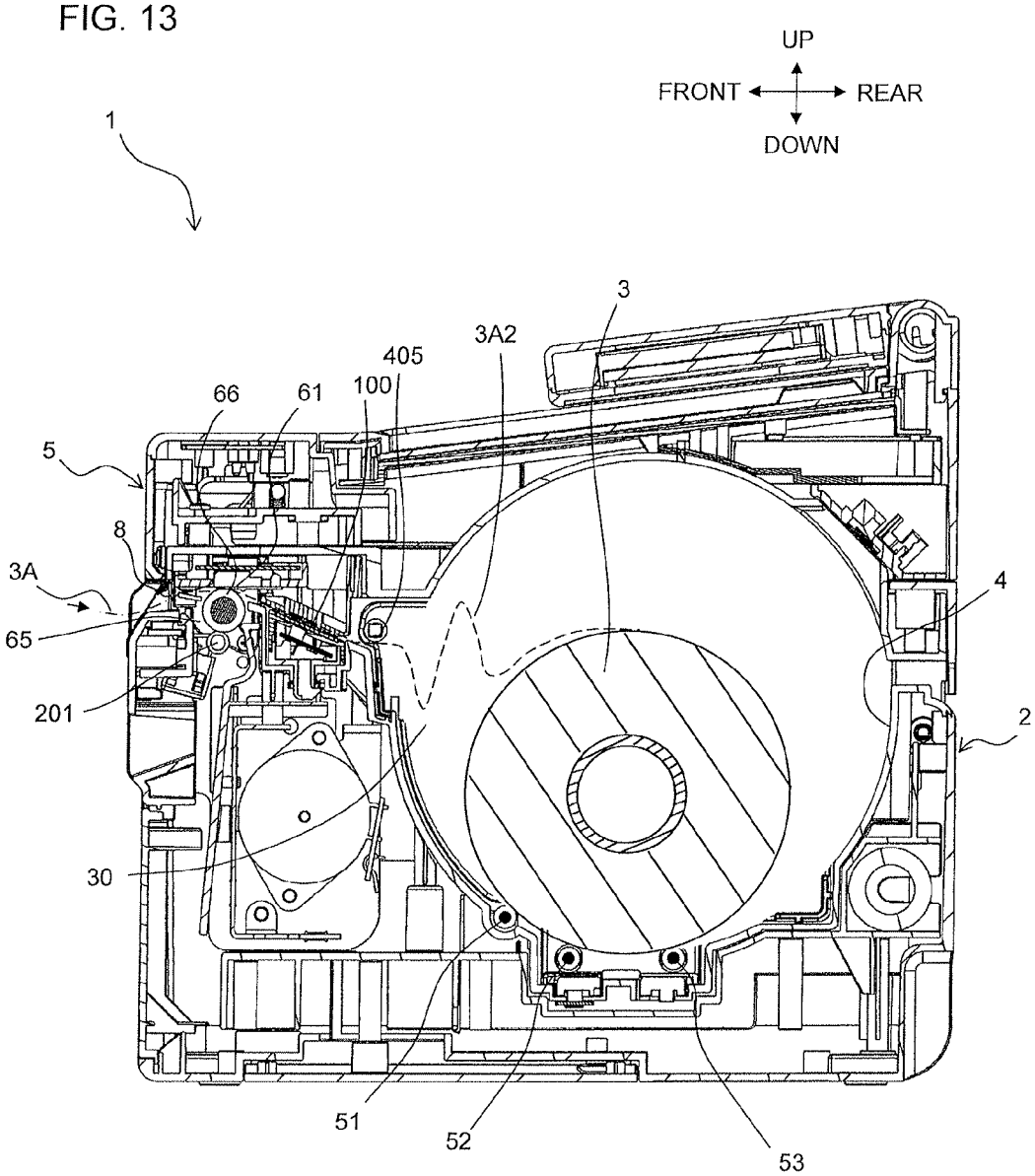
FIG. 13 is an explanatory view showing bending of the print-receiving tape inside the roll storage part during positioning control by reverse direction feeding.

FIG. 13 is an explanatory view showing the bending of the print-receiving tape inside the roll storage part in a case where the paper of the print-receiving tape 3A is soft and there is a relatively small remaining amount of the print-receiving tape 3A inside the roll storage part 4. This example is a case where the above described admissible distance is set to a relatively long distance of 150 mm based on the admissible distance table of FIG. 12, and the print-receiving tape 3A is positioned by the above described feeding of the print-receiving tape 3A in the reverse direction. As shown in the figure, since the remaining tape amount of the print-receiving tape 3A inside the roll storage part 4 is small, a relatively wide empty space 30 is formed between the frontward side of the roll 3 and the above described guide protrusion 405 further frontward therefrom. With this arrangement, the print-receiving tape 3A is stored in the empty space 30 without causing a paper jam, feeding error, or the like, by forming a bending part 3A2 bent into a loose, meandering shape (by the above described reverse direction feeding).

Control Steps

The detailed steps of the load processing of the above described step S10 within the processing executed by the CPU 120 in this modification will now be described using the flowchart of FIG. 14. Components identical to those in the flow of FIG. 11 are denoted using the same reference numerals, and descriptions thereof are omitted or simplified as appropriate.

Figure 14:
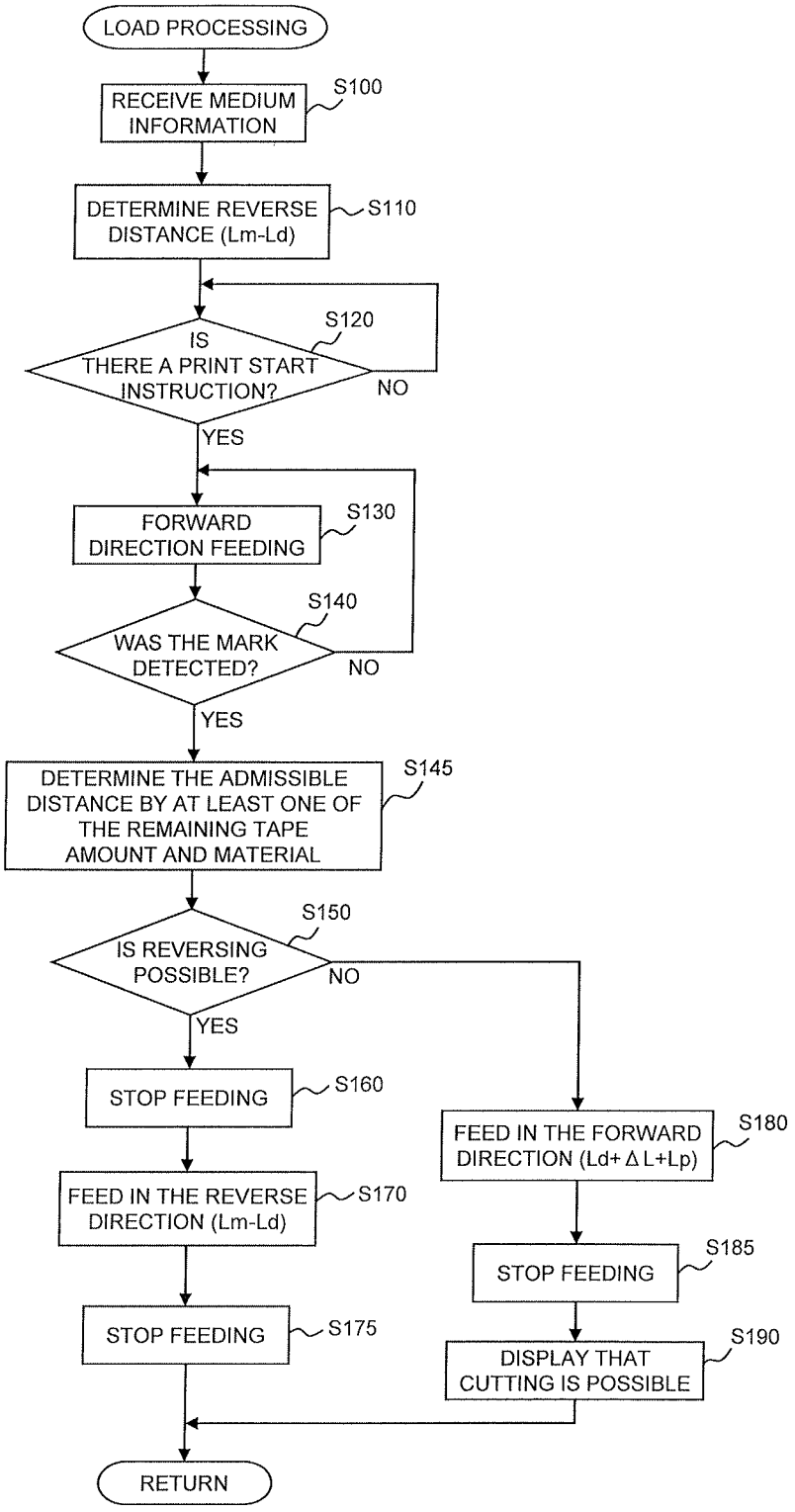
FIG. 14 is a flowchart showing the detailed steps for the load processing executed by the CPU.

In the flow shown in FIG. 14, a new step S145 is added between step S140 and step S150 of the flow of the above described FIG. 11. That is, in FIG. 14, the flow passes through the same step S100, step S110, step S120, step S130, and step S140 as FIG. 11, and then proceeds to the newly disposed step S145.

In step S145, the CPU 120 refers to the above described admissible distance table and determines the above described admissible distance based on at least one of the remaining amount information of the print-receiving tape 3A obtained by a known method as previously described, and the type information (paper information) of the print-receiving tape 3A included in the medium information entered in the above described step S100. Subsequently, the flow proceeds to step S150.

In step S150, similar to FIG. 11, the CPU 120 determines whether or not the above described reverse feeding of the print-receiving tape 3A is possible by whether or not the reverse distance (Lm−Ld) determined in the above described step S110 is less than or equal to the admissible distance determined in the above described step S145. In a case where the above described reverse distance (Lm−Ld) is less than or equal to the above described admissible distance, the condition of step S150 is satisfied (step S150: YES), and the flow proceeds to step S160. In a case where the above described reverse distance (Lm−Ld) is longer than the above described admissible distance, the condition of step S150 is not satisfied (step S150: NO), and the flow proceeds to step S180 described later.

Thereafter, the steps of step S160, step S170, step S175, step S180, step S185, and step S190 are the same as those of FIG. 11, and therefore descriptions thereof are omitted. Note that the CPU 120 that executes the above described step S145 functions as the admissible distance determining part described in the claims.

(2) Variation of Arrangement of the Mark PM

While the mark PM was disposed on the transport direction substantial center part of the print label T in the above described embodiment, the present disclosure is not limited thereto, allowing the mark PM to be disposed on the transport direction tip end part or transport direction rear end part of the print label T.

FIG. 15A is an example of a case where the positions of the plurality of the above described marks PM of the print-receiving tape 3A are set in advance so that the mark PM is positioned in the rear end part of the print label T. In this example, the frontward area 10 (comprising the print area 11) of a transport direction length Lm' is disposed on the transport direction downstream side (the above described frontward side) of the mark PM on the front surface side of the print-receiving tape 3A. The total length of the print label T is L=Lm'+ΔL.

In this modification as well, in the same manner as previously described, after the roll 3 is mounted with the tape tip end 13*a* protruding further toward the frontward side than the above described cutting blade position (refer to FIG. 15B), the print-receiving tape 3A is fed frontward (in the forward direction). Then, once the mark PM is detected by the sensor unit 100 (refer to FIG. 15C), the feeding in the forward direction by the platen roller 66 is stopped.

At the above described moment that the feeding is stopped, the amount of frontward protrusion of the print-receiving tape 3A from the cutting blade position is equivalent to the amount of length of a distance (Lm'−Ld). Hence, in the same manner as described above, the platen roller 66 is driven in the direction reverse to the driving during the above described forward direction feeding and, as shown in FIG. 15D, the print-receiving tape 3A is fed by a reverse distance (Lm'−Ld) in the above described reverse direction toward the rear, and stopped. With this arrangement, the tape tip end 13*a* of the print-receiving tape 3A is accurately positioned in the above described cutting blade position (equivalent to the first initial position).

Note that, in the above, the arrows shown in FIG. 4 denote examples of signal flow, but the signal flow direction is not limited thereto.

Also note that the present disclosure is not limited to the steps shown in the flowcharts of FIG. 10, FIG. 11, and FIG. 14, and step additions and deletions as well as sequence changes may be made without deviating from the spirit and scope of the disclosure.

Further, other than that already stated above, techniques based on the above described embodiments and each of the modifications may be suitably utilized in combination as well.

Although other examples are not individually described herein, various changes can be made according to the present disclosure without deviating from the spirit and scope of the disclosure.

What is claimed is:

1. A printer comprising:

a storage device configured to detachably store a print-receiving medium comprising a plurality of identifiers for positioning;

a feeder configured to feed said print-receiving medium stored in said storage device;

a printing head configured to perform desired printing on said print-receiving medium fed in a forward direction along a transport direction by said feeder;

a detecting device configured to detect said identifier of said print-receiving medium, disposed on a feeding path of said print-receiving medium by said feeder;

an instruction input portion for inputting an operation instruction for starting print processing;

a first control portion for controlling said feeder so as to start feeding of said print-receiving medium in said forward direction, in accordance with said operation instruction for starting print processing via said instruction input portion;

a detection determining portion for determining whether or not said detecting device detects said identifier after feeding of said print-receiving medium in said forward direction was started by said first control portion;

a second control portion for controlling said feeder so as to feed said print-receiving medium in a reverse direction that is reverse to said forward direction, and to position a position of said print-receiving medium along said transport direction in a predetermined first initial position in a case that said detection determining portion determined that said detecting device detects said identifier;

a reverse determining portion configured to determine whether or not a predetermined reversibility condition related to a feeding of said print-receiving medium in said reverse direction based on control of said second control portion has been satisfied; and a third control portion configured to control said feeder so as to further feed said print-receiving medium in said forward direction, and to position the position of said print-receiving medium along said transport direction in a predetermine second initial position when said reverse determining portion has determined that said reversibility condition has not been satisfied and said detection determining portion determined that said detecting device detected said identifier, wherein:

said second control portion controls said feeder so as to feed said print-receiving medium in said reverse direction and to perform said positioning when said reverse determining portion determined that said reversibility condition has been satisfied and said detection determining portion determined that said detecting device detected said identifier.

2. The printer according to claim 1, further comprising:

an information input portion configured to input medium information that includes at least a disposed mode of said identifier on said print-receiving medium; and a reverse distance determining portion configured to determine a feeding distance that should be performed at a feeding in said reverse direction by said second control portion, based on the disposed mode of said identifier included in said medium information input by said information input portion, wherein:

said reverse determining portion determines whether or not said feeding distance determined by said reverse distance determining portion is less than or equal to an admissible distance determined in advance as said reversability condition.

3. The printer according to claim 2, further comprising admissible distance determining portion configured to variably determine said admissible distance based on at least one of remaining amount information of said print-receiving medium and material information of said print-receiving medium.

4. A non-transitory computer-readable recording medium, storing a print control program for executing steps on a calculating device provided at a printer comprising: a storage device configured to detachably store a print-receiving medium comprising a plurality of identifiers for positioning; a feeder configured to feed said print-receiving medium stored in said storage device; a printing head configured to perform desired printing on said print-receiving medium fed in a forward direction along a transport direction by said feeder; detecting device configured to detect said identifier of said print-receiving medium, disposed on a feeding path of said print-receiving medium by said feeder; and said calculating device; said steps comprising:

an instruction input step for inputting an operation instruction for starting print processing;

a first control step for controlling said feeder so as to start feeding of said print-receiving medium in said forward direction, in accordance with said operation instruction for starting print processing in said instruction input step;

a detection determining step for determining whether or not said detecting device detects said identifier after feeding of said print-receiving medium in said forward direction was started in said first control step;

a second control step for controlling said feeder so as to feed said print-receiving medium in a reverse direction that is reverse to said forward direction, and to position a position of said print-receiving medium along said transport direction in a predetermined first initial position in a case that it was determined that said detecting device detects said identifier in said detection determining step;

a reverse determining step for determining whether or not a predetermined reversibility condition related to a feeding of said print-receiving medium in said reverse direction based on control in said second control step has been satisfied; and a third control step for controlling said feeder so as to further feed said printer-receiving medium in said forward direction, and to position the position of said printer-receiving medium along said transport direction in a predetermined second initial position when in said reverse determining step it is determined that said reversibility condition has not been satisfied and in said detection determining step it is determined that said detecting device detected said identifier, wherein:

in said second control step, said feeder is controlled so as to feed said print-receiving medium in said reverse direction and to perform said positioning when in said reverse determining step it is determined that said reversibility condition has been satisfied and in said detection determining step it is determined that said detecting device detected said identifier.

* * * * *